US008782943B2

(12) United States Patent
Jarboe

(10) Patent No.: US 8,782,943 B2
(45) Date of Patent: Jul. 22, 2014

(54) QUICK DETACH BARREL MOUNTING SYSTEM

(71) Applicant: RA Brands, L.L.C., Madison, NC (US)

(72) Inventor: Michael Brent Jarboe, Rineyville, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 13/662,236

(22) Filed: Oct. 26, 2012

(65) Prior Publication Data

US 2014/0115938 A1 May 1, 2014

(51) Int. Cl.
*F41A 21/48* (2006.01)

(52) U.S. Cl.
USPC ..... 42/75.02

(58) Field of Classification Search
USPC ..... 42/71.01, 75.01, 75.02, 75.06
See application file for complete search history.

(56) References Cited

U.S. PATENT DOCUMENTS

| | | | | |
|---|---|---|---|---|
| 2,736,119 | A | 2/1956 | Clarkson et al. | |
| 3,611,611 | A | 10/1971 | Quinney | |
| 3,842,527 | A | 10/1974 | Low | |
| 3,877,167 | A * | 4/1975 | Keppeler | 42/75.02 |
| 4,920,679 | A | 5/1990 | Sarles et al. | |
| 5,020,260 | A * | 6/1991 | Houghton | 42/75.02 |
| 5,410,834 | A | 5/1995 | Benton et al. | |
| 5,412,895 | A * | 5/1995 | Krieger | 42/75.02 |
| 5,706,599 | A | 1/1998 | Knight | |
| 5,900,577 | A | 5/1999 | Robinson et al. | |
| 5,987,797 | A | 11/1999 | Dustin | |
| 6,205,696 | B1 | 3/2001 | Bilgeri | |
| 6,606,812 | B1 | 8/2003 | Gwinn, Jr. | |
| 6,655,372 | B1 | 12/2003 | Field et al. | |
| 6,848,351 | B1 | 2/2005 | Davies | |
| 7,451,564 | B2 | 11/2008 | Wait | |
| 7,523,580 | B1 * | 4/2009 | Tankersley | 42/71.01 |
| 7,574,823 | B2 | 8/2009 | Nakayama | |
| 7,793,452 | B1 | 9/2010 | Samson et al. | |
| 7,905,041 | B1 * | 3/2011 | Davies | 42/75.02 |
| 8,087,194 | B1 * | 1/2012 | Vuksanovich | 42/75.02 |
| 8,234,808 | B2 | 8/2012 | Lewis et al. | |

(Continued)

OTHER PUBLICATIONS

Zimba, Jeff W.; Another Tactical Upgrade from MGI Military: The QCB Upper Receiver for the AR-15/M16/M4; The Small Arms Review, vol. 8 No. 3; pp. 37-40; Dec. 2004.

(Continued)

*Primary Examiner* — Bret Hayes
(74) *Attorney, Agent, or Firm* — Womble Carlyle Sandridge & Rice, LLP

(57) ABSTRACT

A quick-detach barrel mounting system for removing and attaching a barrel to a receiver of a firearm. The quick-detach barrel mounting system can include a barrel nut having a body defining an axial bore. A proximal end of the barrel is received at least partially through the axial bore, and the barrel nut releasably engages a front end of the receiver. A hand guard can be mounted to the receiver and can define a cutout proximate the receiver. The hand guard at least partially encloses at least a portion of the barrel and the barrel nut, and the cutout is at least partially aligned with the barrel nut. At least a portion of the barrel nut is accessible via the cutout of the hand guard for at least partially disengaging and engaging the barrel nut with the receiver when the hand guard is mounted on the receiver.

27 Claims, 13 Drawing Sheets

(56) References Cited

U.S. PATENT DOCUMENTS

| | | | | |
|---|---|---|---|---|
| 2004/0049964 | A1* | 3/2004 | Vais | 42/75.02 |
| 2005/0115398 | A1 | 6/2005 | Olson | |
| 2005/0188591 | A1 | 9/2005 | Stone | |
| 2006/0010748 | A1 | 1/2006 | Stoner | |
| 2007/0017139 | A1 | 1/2007 | Larue | |
| 2007/0199435 | A1 | 8/2007 | Hochstrate et al. | |
| 2008/0276797 | A1* | 11/2008 | Leitner-Wise | 89/191.01 |
| 2010/0300277 | A1 | 12/2010 | Hochstrate et al. | |
| 2010/0319231 | A1* | 12/2010 | Stone et al. | 42/71.01 |
| 2011/0016762 | A1 | 1/2011 | Davies | |
| 2011/0061281 | A1* | 3/2011 | Kapusta et al. | 42/71.01 |
| 2012/0073177 | A1* | 3/2012 | Laney et al. | 42/16 |
| 2012/0124880 | A1* | 5/2012 | Leclair | 42/71.01 |
| 2012/0180354 | A1 | 7/2012 | Sullivan et al. | |

OTHER PUBLICATIONS

Alpo, Paul V.; Assault Rifle Update; Armada International, vol. 29 No. 4; p. 64(7); Aug.-Sep. 2005.

International Search Report dated Jan. 23, 2014 for International Patent Application No. PCT/US2013/066809 filed Oct. 25, 2013.

Written Opinion dated Jan. 23, 2014 for International Patent Application No. PCT/US2013/066809 filed Oct. 25, 2013.

* cited by examiner

QUICK DETACH BARREL MOUNTING SYSTEM

TECHNICAL FIELD

Embodiments of the disclosure are directed generally to firearms and, more particularly, to an apparatus for facilitating mounting and removal of a barrel from the receiver of a firearm.

BACKGROUND INFORMATION

Manual firearms, such as rifles and shotguns, are designed to fire a round of ammunition, such as a cartridge or shot shell, in response to each squeeze of the trigger of the firearm, and thereafter a bolt assembly in the receiver of the firearm will be manually operated to eject the empty shell or cartridge casing and load the next shell or cartridge from the firearm magazine into the chamber of the firearm. Semi-automatic firearms are designed to fire a round of ammunition, such as a cartridge or shot shell, in response to each squeeze of the trigger of the firearm, and thereafter automatically eject the spent shell or cartridge and load the next shell or cartridge from the firearm magazine into the chamber of the firearm. During firing, the primer of the round of ammunition ignites the propellant inside the round, producing an expanding column of high pressure gases within the chamber and barrel of the firearm. The force of this expanding gas propels the bullet/shot of the cartridge or shell down the barrel.

It is becoming desirable now in military, and even civilian sporting firearms, that the barrel of such firearms be easily replaceable to enable a change of calibers of ammunition to be used in the firearm and/or to provide for replacement of damaged barrels and/or use of barrels of different lengths for different end use scenarios. The changeout of barrels is, however, often further complicated by the use of various hand guards and accessory rail assemblies typically mounted about the barrels of such firearms. In addition, the increasing use of monolithic or one-piece receiver and hand guard assemblies, especially in military firearms, has further complicated barrel removal in these types of firearms. Typically, the hand guards, and often other accessories, must be removed from the firearm prior to the removal and replacement of the barrel, can significantly increase the difficulty and time required for barrel change-out. Such a process further is complicated when it must be done in the field. Additionally, optics used with the firearm may need to be reassembled and recalibrated when reassembling a hand guard to a firearm after changing a barrel, which requires additional expertise and time.

Accordingly, it can be seen that a need exists for a barrel mounting and retention assembly that addresses the foregoing and other related and unrelated problems in the art.

SUMMARY OF THE DISCLOSURE

Briefly described, in one embodiment of the invention, a quick-detach barrel mounting system is provided for enabling faster and/or more efficient change-out or replacement of the barrel of a firearm. The barrel mounting and retention device generally comprises a barrel extension defining a first axial bore and being disposed at a proximal end of the barrel adjacent a chamber portion of the barrel. An annular collar can be formed about a forward or first portion of the barrel extension and will comprise a first clamp face. A barrel nut engages the annular collar for securing the barrel and generally includes a second axial bore with an annular shoulder formed adjacent the second axial bore. The barrel nut further can include at least one radial bore or other mating geometry for receiving a tool to help disengage the barrel nut from the firearm receiver. The annular shoulder of the barrel nut can engage the first clamp face of the annular collar to clamp the collar between the annular shoulder and a portion of the receiver and secure the barrel to the receiver.

The at least one radial bore in the barrel nut generally will be accessible for engagement of the barrel nut by a tool via a cutout formed in the hand guard at a location aligned with the barrel nut when the barrel nut is engaged with a portion of the receiver. A tool can be inserted through the cutout in the hand guard for access and engaging the at least one radial bore of the barrel nut. Thereafter, the tool can be used to loosen or tighten the barrel nut on the forward end of the receiver as needed, after which the user can easily manipulate the barrel nut via the cutout to either remove the barrel from or secure the barrel in engagement with the receiver with the barrel mounting and retention device. In one embodiment, the cutout of the hand guard and the construction of the handguard is configured to provide a secure, stable mounting of the hand guard out of contact with the barrel, while enabling sufficient and easy access to the barrel nut for manipulation thereof by hand to facilitate the assembly and disassembly of the barrel and the barrel mounting and retention device with the receiver without disassembly and removal of the hand guard from the firearm.

These and various other advantages, features, and aspects of the exemplary embodiments will become apparent and more readily appreciated from the following detailed description of the embodiments taken in conjunction with the accompanying drawings, as follows.

Figure 1A:
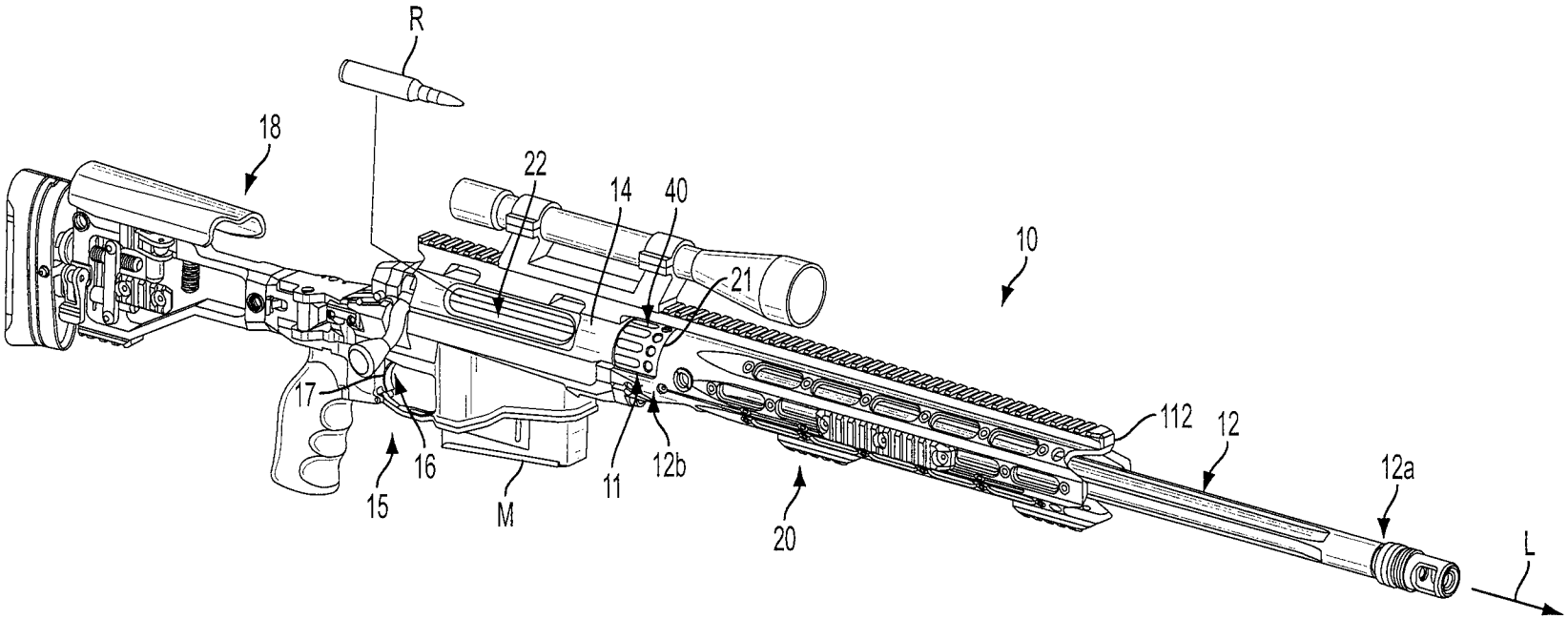
FIG. 1A is an isometric view of a firearm with a quick-detach barrel mounting system according to a first exemplary embodiment of the disclosure.

Those skilled in the art will appreciate and understand that, according to common practice, the various features of the drawings discussed below are not necessarily drawn to scale, and that dimensions of various features and elements of the drawings may be expanded or reduced to more clearly illustrate the embodiments of the present invention described herein.

DETAILED DESCRIPTION OF THE EXEMPLARY EMBODIMENTS

Referring now to the drawings in which like numerals indicate like parts throughout the several views, the figures illustrate example embodiments of the quick-detach barrel mounting and retention apparatus or system according to the principles of the present disclosure for use in a firearm such as a precision sniper rifle (PSR), modular sniper rifle (MSR), and/or similar types of firearms. However, it will be understood that the principles of the barrel mounting and retention device of the present invention can be used in various types of firearms including shotguns, rifles, and other long guns. The illustrated embodiment, included by way of example, shows a bolt action firearm. However, the present disclosure should not be limited to the illustrated example. The following description is provided as an enabling teaching of exemplary embodiments, and those skilled in the relevant art will recognize that many changes can be made to the embodiments described. It also will be apparent that some of the desired benefits of the embodiments described can be obtained by selecting some of the features of the embodiments without utilizing other features. Accordingly, those skilled in the art will recognize that many modifications and adaptations to the embodiments described are possible and may even be desirable in certain circumstances, and are a part of the invention. Thus, the following description is provided as illustrative of the principles of the embodiments and not in limitation thereof, since the scope of the invention is defined by the claims.

Figure 1B:
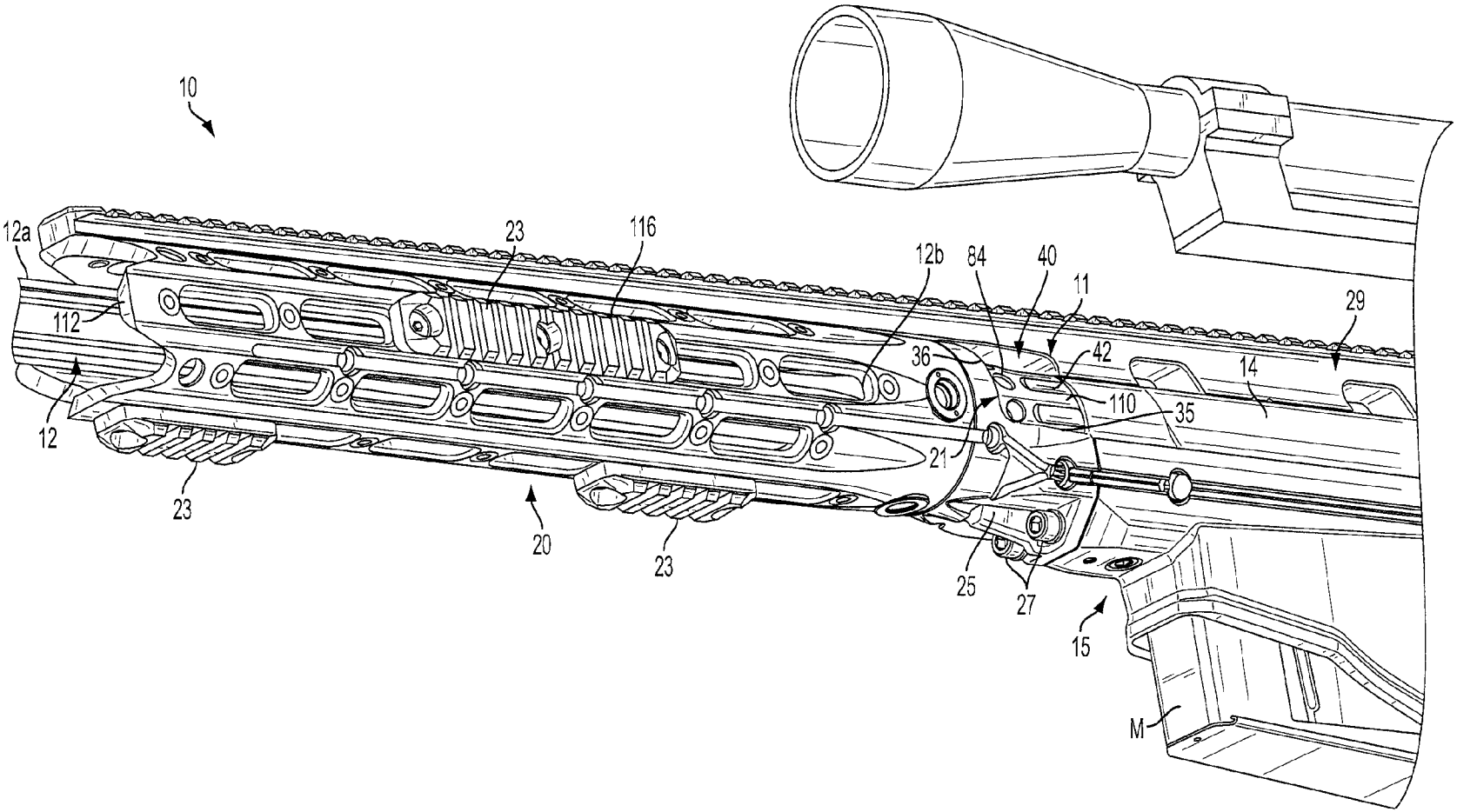
FIG. 1B is an isometric view of the hand guard and quick-detach barrel mounting system of FIG. 1A viewed from below the hand guard.
Figure 1C:
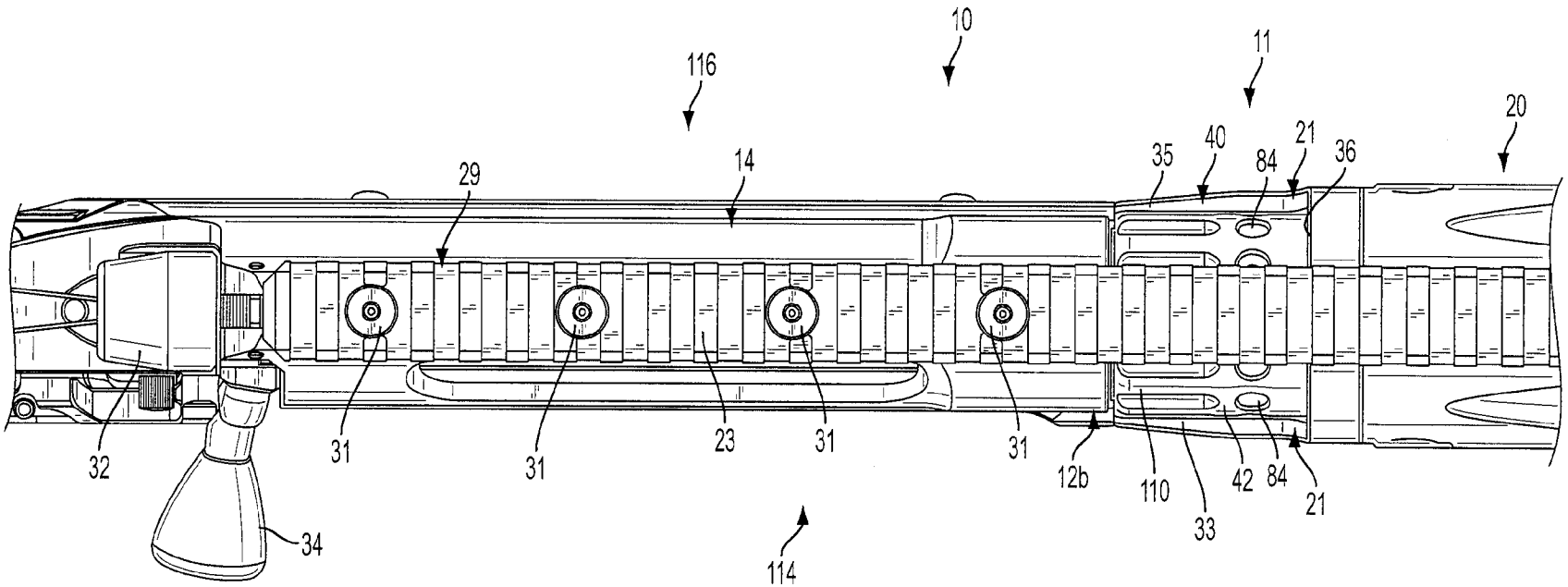
FIG. 1C is a top view of a portion of the firearm of FIGS. 1A-1B.

FIG. 1A illustrates a firearm 10 showing a quick-detach barrel mounting system 11 in one exemplary embodiment. The firearm 10 generally is shown as a rifle and includes a barrel 12 extending along a longitudinal axis L and having a forward or muzzle end 12*a* and a proximal or rear end 12*b*, with the a quick-detach barrel mounting system 11 connecting the barrel to an receiver 14. The firearm further generally includes a chassis 15, and a stock 18. A hand guard 20 also can be affixed to at least the receiver 14, extending along the barrel with the barrel "floating" therein. For example, the firearm can include a hand guard that is affixed to the receiver 14 and/or the chassis 15 by fasteners, for example, or an AR-style two-piece receiver and hand guard. Alternatively, the hand guard 20 or any other type of hand guard can be integral with and/or otherwise utilized with the firearm 10, or a hand guard can be omitted from the firearm. The firearm additionally can incorporate a monolithic, integral upper-style receiver and hand guard, wherein the hand guard is integrally formed with the receiver. As shown in FIGS. 1A-1C, the hand guard 20 generally will include a cutout 21 to provide access to a barrel mounting and retention device 40, the cutout 21 and the barrel mounting and retention device 40 forming the quick-detach barrel mounting system 11. The stock 18, also known as the buttstock or shoulder stock, may be formed in any conventional manner to include cushioning, special curvatures, grips, hinges, adjustment features, etc.

Figure 2:
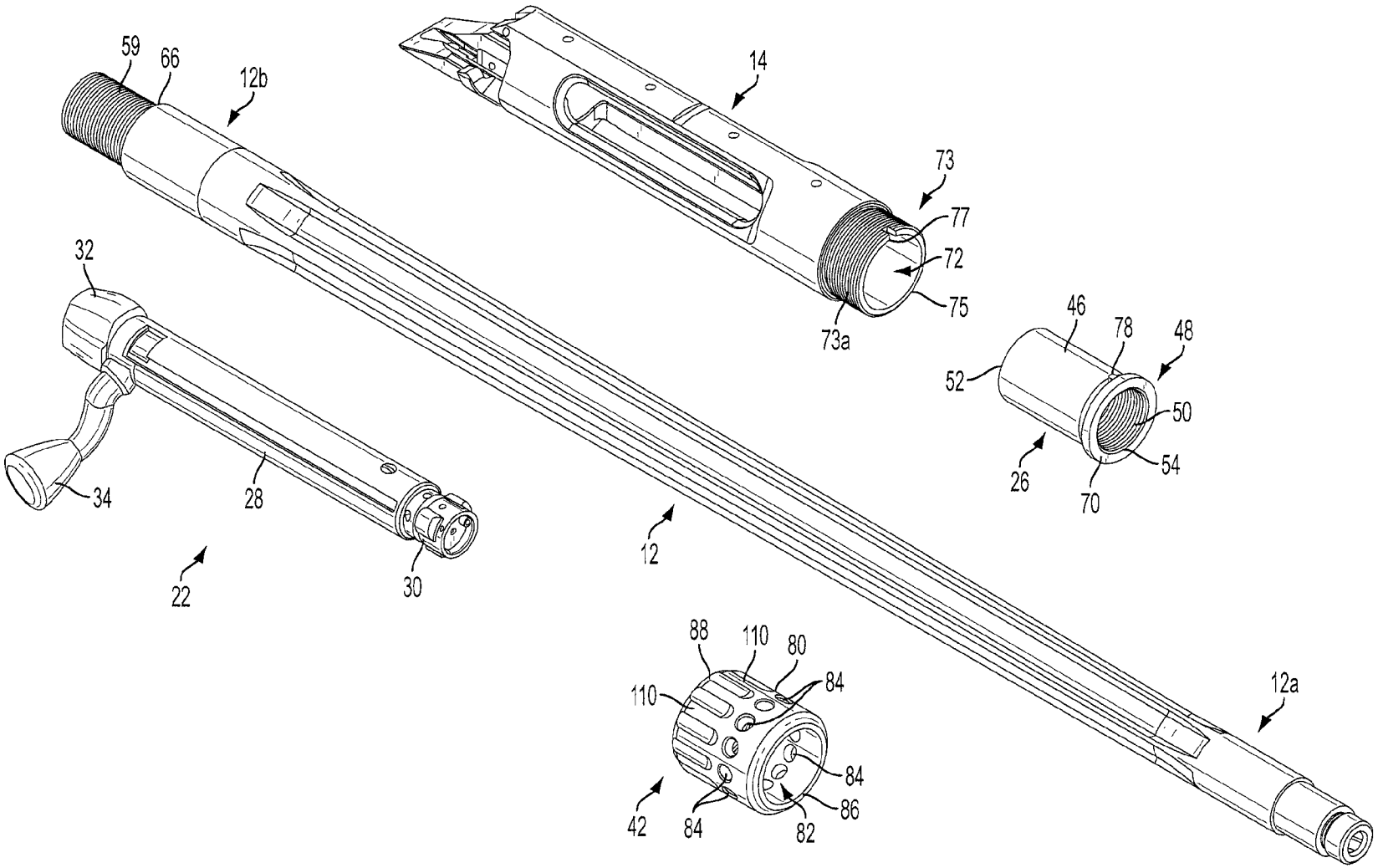
FIG. 2 is an exploded isometric view of the barrel, a barrel extension, a barrel nut, a bolt assembly, and receiver of the firearm of FIG. 1A.
Figure 4:
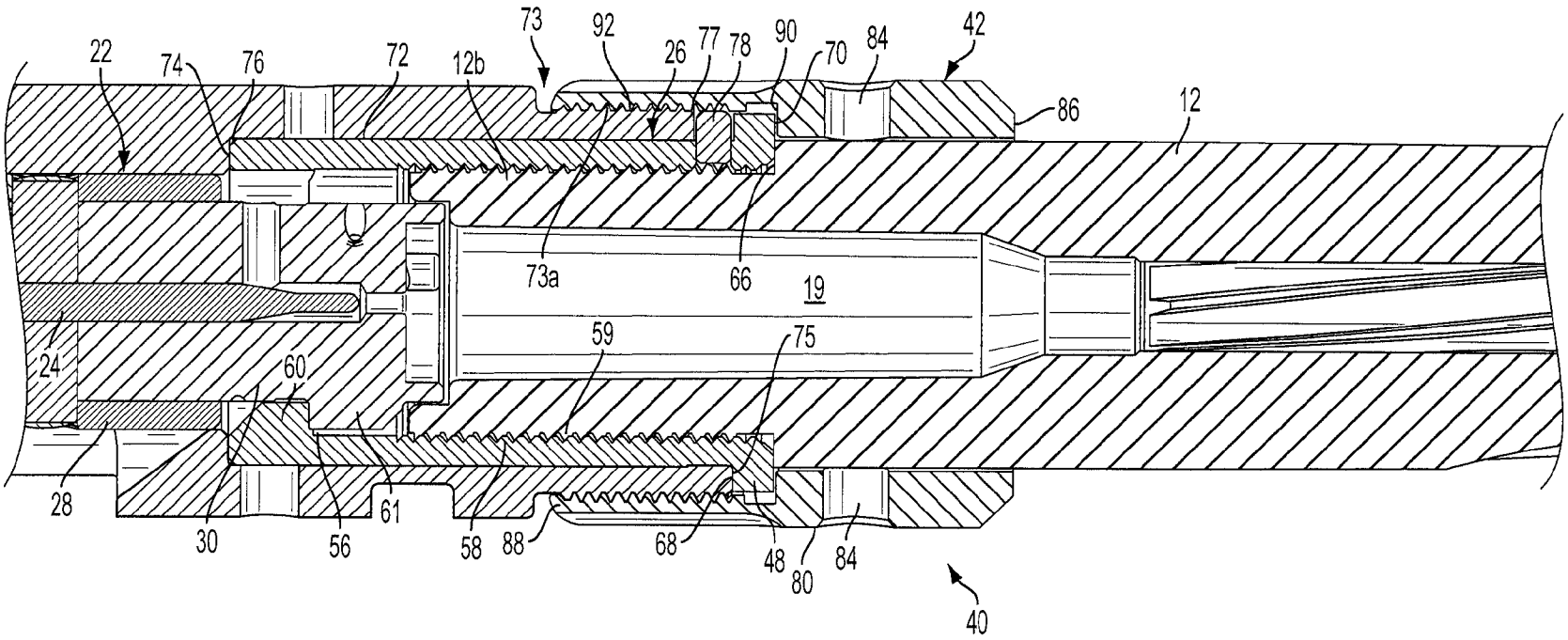
FIG. 4 is a cross-sectional view of the barrel mounting and retention device of FIGS. 1A-1B.

The receiver 14 houses and includes the firing mechanism or fire control 16 of the firearm, including a trigger 17 for actuating the firearm (FIG. 1A). A breech bolt or bolt assembly 22 and a firing pin 24 also generally will be included in the receiver 14 (FIGS. 2 and 4). The bolt assembly 22 is translatable axially in both forward and rearward directions along the receiver during the ejection and loading cycle and generally is located behind and communicates with a barrel extension 26 and a chamber portion 19 (FIG. 4) at the rear end 12*b* of the barrel 12. The chamber receives a round of ammunition R (FIG. 1A), such as a shell or cartridge for firing, typically from a magazine M (FIG. 1A) received within the chassis 15.

In the illustrated embodiment, the receiver 14 and the chassis 15 can be secured together (e.g., with fasteners). As shown in FIGS. 2 and 4, the receiver 14 includes a front end 73 that defines an axial bore 72. The axial bore 72 can receive a portion of the barrel extension 26, which is part of the barrel mounting and retention device 40 (FIG. 4). The front end 73 includes an externally-threaded portion 73*a* that interfaces with a barrel nut 42 of the barrel mounting and retention device 40 (FIG. 4). As shown in FIG. 2, the front end 73 can include a notch or recess 77 in the forward facing surface 75 of the receiver 14 that can receive an alignment feature in the barrel extension 26 (FIG. 4).

As shown in FIGS. 1-1C, the hand guard 20 generally will enclose at least a portion of the barrel 12 with the barrel affixed to the receiver 14 by the barrel mounting and retention device 40 and generally floating or otherwise remaining free from connection to the hand guard 20. The hand guard 20 can include one or more Picatinny rails 23 and/or other accessory features, and one or more accessories (e.g., a scope, a flashlight, etc.) can be affixed to one or more of the Picatinny rails 23. A proximal end 25 of the hand guard 20 further can be in abutting contact with or otherwise engage a forward face of the chassis 15 (FIG. 1B), and can be secured thereto such as by fasteners 27 (e.g., cap screws, rivets, pins, etc.). For example, in one embodiment, the fasteners 27 comprise two cap screws that pass through respective holes in the proximal end 25 and engage respective threaded bores in the forward face of the chassis 15 (FIG. 1B). The hand guard 20 also can include an upper extension 29 that extends over and is secured to the receiver 14 (FIG. 1C), such as by fasteners 31 (e.g., cap screws, rivets, pins, etc.), shown in one embodiment as comprising four screws that pass through holes in the upper extension 29 and engage respective threaded bores in the top of the receiver 14 (FIG. 1C). In one embodiment, the upper extension 29 can include a portion of a monolithic rail that is integrally formed with or can be affixed to the receiver and a guard portion of the hand guard 20. Alternatively, the hand guard 20 can be otherwise secured to or integral with the receiver 14 and/or the chassis 15.

In the illustrated embodiment, the cutout 21 of the hand guard 20 is formed between a rearward face of the hand guard 20 and the receiver 14 above the proximal end 25 of the hand guard (FIGS. 1B and 1C). As shown in FIG. 1C, the upper extension 29 of the hand guard 20 can extend over the cutout 21, with the cutout including/defining a series of spaced access openings or areas about the circumference of the hand guard. In one embodiment, the cutout 21 can be formed with the hand guard 20 (e.g., the cutout 21 can be formed by a feature of a mold when molding the hand guard). Alternatively, or in addition, the cutout 21 can be cut, carved, shaved, and/or otherwise formed in the pre-formed hand guard 20. The cutout 21 can include a first longitudinal edge 33 on a first side 114 of the firearm 10, a second longitudinal edge 35 on the opposing second side 116 of the firearm, and a rearward-facing edge 36 extending between the first longitudinal edge 33 and the second longitudinal edge 35. Accordingly, the cutout 21 generally will be configured to provide easy access to the barrel nut 42 on either side of the firearm 10 to enable engagement and manipulation of the barrel nut by hand, from either side of the firearm, while the hand guard 20 remains attached to the receiver 14 and the chassis 15. In one embodiment, the cutout 21 is sized so that a tool (e.g., the tool 100 shown in FIG. 5A) and/or a user's fingers can access and manipulate the barrel nut 42 through the cutout 21 without removing the hand guard 20, and without diminishing the stability of the mounting of the barrel or the hand guard to the receiver.

In the illustrated embodiment, the longitudinal edges 33, 35 of the cutout are generally parallel to and disposed below the longitudinal axis L of the barrel 12 so that the top half and at least a portion of the lower half of the barrel nut 12 are accessible through the cutout, above the longitudinal edges 33, 35. Accordingly, a user can grasp the barrel nut through the cutout 21 below a ridge 110 on one side of the firearm and above a generally opposing ridge 110 on the other side of the firearm with respective fingers of one or both hands to rotate the barrel nut on the front end 73 of the receiver 14. The rearward-facing edge 36 of the cutout is spaced apart from the front end 73 of the receiver 14 (FIG. 5B), e.g., by a distance approximately equal to half the length of the barrel nut, so as to facilitate and ensure a stable mounting to and support of the hand guard from the receiver, and to ensure the barrel nut 42 is easily accessible through the cutout 21 even when the barrel nut is disengaged from the front end 73 of the receiver. Accordingly, a user can reach into the cutout 21, grasp the barrel nut 42, engage the barrel nut with the front end, and turn the barrel nut so that the threaded portion 92 of the barrel nut engages the external threads 73*a* of the front end.

The cutout 21 and the hand guard 20 also can be otherwise configured without departing from the scope of the disclosure. For example, the cutout could be formed on a single side of the firearm, or could additionally provide access to the barrel nut 42 from the top and/or the bottom of the firearm. Still further, the cutout generally will be located along the hand guard and will be configured and sized to accommodate easy and consistent access to the barrel nut by different users with various hand sizes, including when users wear gloves, without interfering with or otherwise diminishing the strength of the connection between the receiver and the hand guard, including integrally formed receivers and hand guards. For example, the cutout 21 can provide a total access opening size of approximately 1-4 square inches, although greater or lesser total opening sizes also can be used, on one or both sides of the firearm 10 to provide clearance for various hand sizes, with a range of finger sizes from small fingers to large, gloved fingers to reach through the cutout and engage the ridges 110 of the barrel nut and to move up and/or down in the cutout to turn the barrel nut.

In the firearm 10, the bolt assembly 22 is shown in one embodiment as including a bolt body 28, a bolt head 30, and a bolt plug 32 (FIGS. 2 and 4) for operation of the firearm for ejecting a spent shell or casing and reloading the chamber after firing by way of translating the bolt assembly 22 of the firearm 10 rearwardly and forwardly in relation to the receiver 14. During an ejection and loading operation, the bolt assembly is rotated and pulled rearwardly away from the chamber portion 19 of the barrel 12. This rearward translation of the bolt causes a spent cartridge/shell casing to be automatically cleared or ejected from the chamber 19 (e.g., by an extractor and ejector mechanism in the bolt head 30). A new round R then can be advanced and positioned adjacent the bolt head 30 by the magazine M, and the bolt assembly 22 can be pushed forward and locked into engagement with the barrel extension 26 so that the round R is loaded into the chamber. The bolt can be recocked and readied for firing.

Figure 3:
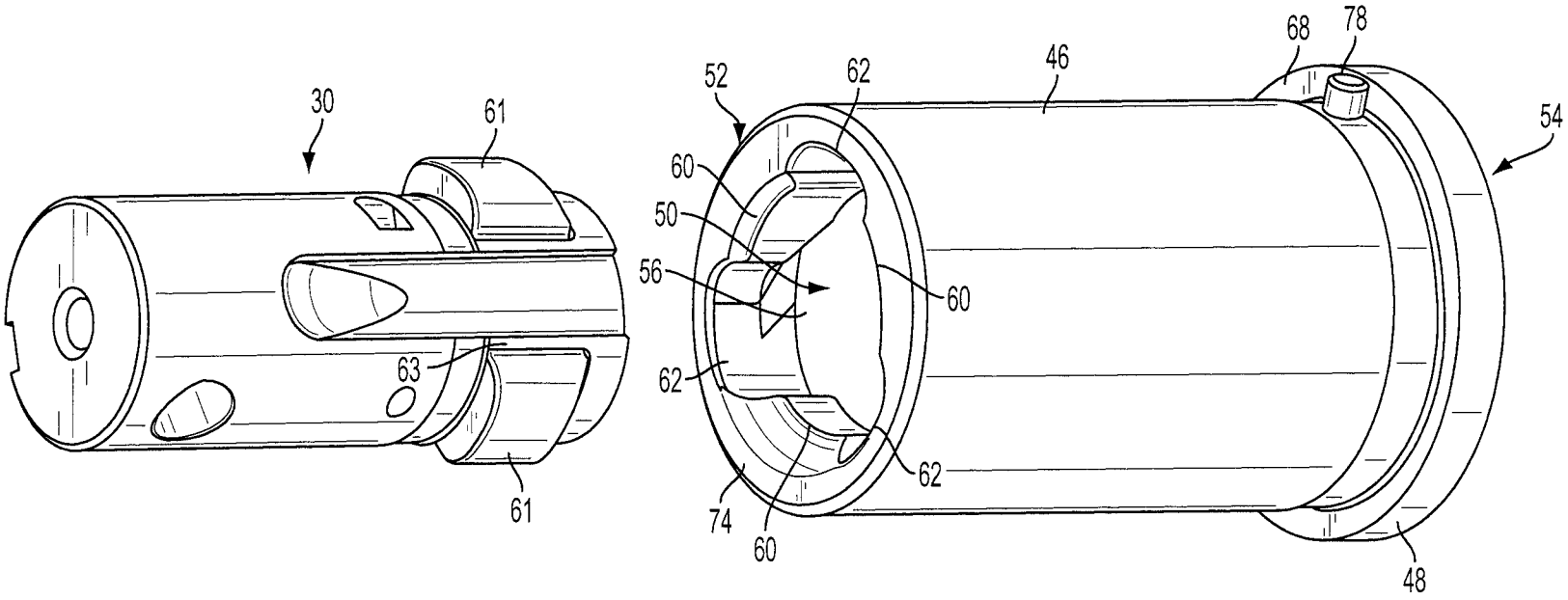
FIG. 3 is isometric view of the barrel extension and a bolt head of the bolt assembly of FIG. 2.

As shown in FIGS. 2-4, the barrel mounting and retention device 40 includes a barrel nut 42 and the barrel extension 26, which cooperate to secure and retain the barrel 12 in abutting engagement with the receiver 14. As shown in FIGS. 2-4, the barrel extension 26 generally includes a cylinder section 46 and an annular boss or collar 48. The cylinder section 46 can include an axial bore 50 extending from a bolt-receiving end 52 of the barrel extension 26 to a barrel-receiving end 54 adjacent the collar 48. As shown in FIGS. 3 and 4, the axial bore 50 can include a bolt-interlocking section 56 adjacent the bolt-receiving end 52 and a threaded section 58 extending from the bolt interlocking section 56 to the barrel-receiving end 54 for engaging external threads 59 formed about the rear end 12*b* or the chamber portion 19 of the barrel 12 (FIGS. 2 and 4). The cylinder section 46 can slide axially into the axial bore 72 of the receiver 14 (FIGS. 2 and 4) to interface with the bolt assembly 22 of the firearm 10.

As shown in FIGS. 3 and 4, the bolt-receiving end 52 further includes a plurality of locking lugs 60 extending radially into the axial bore 50 with recesses 62 formed between the locking lugs 60. The bolt head 30 of the bolt assembly 22 can include a plurality of corresponding lugs 61 and recesses 63 at its forward end. The lugs 61 of the bolt head 30 can engage the recesses 62 of the barrel extension 26 and the locking lugs 60 of the barrel extension 26 can engage the recesses 63 of the bolt head 30 when the forward end of the bolt head 30 is passed through the bolt-receiving end 52 and into the interlocking section 56 of the barrel extension 26, such as when chambering a round R into the chamber 19. Thereafter, with the lugs 61 of the bolt head 30 received within the interlocking section 56 (FIG. 4), the bolt assembly 22 can be rotated to at least partially align the lugs 61 of the bolt head 30 with the locking lugs 60 to lock the bolt assembly 22 to the barrel extension 26 (FIG. 4) for firing the firearm 10. After a firing operation, the bolt assembly can be rotated in an opposite direction so that the lugs 61 of the bolt head 30 are generally aligned with the recesses 62 of the barrel extension 26 and the bolt head 30 then can be pulled rearwardly to withdraw from the barrel extension 26 (FIG. 3) to extract a spent shell or cartridge casing from the chamber prior to chambering another round. The bolt assembly 22 can include a bolt handle 34 extending from the bolt body 28. The bolt handle 34 can be grasped for rotating and translating the bolt assembly 22 within the receiver 14. Alternatively, the bolt assembly 22 and the ejection and loading cycle can be controlled by a gas operating system in an automatic or semi-automatic firearm.

As shown in FIG. 4, the threaded section 58 of the axial bore 50 can receive the rear end 12*b* of the barrel 12, which includes at least a portion of the chamber 19. The threaded section 58 can be threaded for interfacing with the external threads 59 formed about the rear end 12*b* of the barrel 12 for attaching the barrel to the barrel extension. The collar 48 can engage and abut against a shoulder 66 proximate the external threads 59 of the barrel 12 when the barrel extension 26 is in engagement with the rear end 12*b* of the barrel. Alternatively, an annular barrel stop shoulder can be formed within the axial bore at the barrel-receiving end 54, and the barrel stop shoulder can engage the rearward face of the shoulder 66.

As shown in FIGS. 2-4, the collar 48 of the barrel extension 26 generally includes a rearward face 68 and a forward face 70. The rearward face 68 extends outwardly from the cylinder section 46 in a generally radial direction to provide a generally flat rearward facing surface for engaging the forward facing surface 75 of the receiver 14 (FIGS. 2 and 4). Accordingly, a clamp force applied along the longitudinal axis L of the barrel 12 tends to urge the rearward face 68 against the forward surface 75 of the receiver. The generally flat nature of the rearward face 68 allows proper seating of the collar 48 against the receiver 14 for secure retention of the barrel extension 26, and thus the barrel 12, to the receiver 14, as well as proper alignment of the longitudinal axis L of the barrel 12 with a longitudinal axis of the receiver, with minimal effort by a user. No tools are required for alignment of the barrel and the receiver.

In the illustrated embodiment, the barrel extension 26 can be inserted into the axial bore 72 of the front end 73 of the receiver 14 until a rearward face 74 of the bolt-receiving end 52 of the barrel extension 26 engages a stop shoulder 76 of the axial bore 72 of the receiver. The axial bore 72 and the cylinder section 46 can be configured so that both of the rearward faces 68, 74 of the barrel extension 26 engage the respective forward surface 75 and stop shoulder 76 of the receiver 14, or only one of the rearward faces 68, 74 engages the respective forward surface 75 or stop shoulder 76. While the rearward faces 68, 74, the forward surface 75, and the stop shoulder 76 are generally perpendicular to the longitudinal axis L of the firearm as shown in the figures, one or more of these features can be oblique and/or curved to encourage alignment and/or proper seating of the respective features.

As shown in FIGS. 2-4, the barrel extension 26 can include an alignment pin 78 extending radially from the cylinder section 46 that engages the recess 77 in the forward surface 75 of the receiver 14 (FIGS. 2 and 4). In the illustrated embodiment, the alignment pin 78 is seated in a bore in the cylinder section 46 of the barrel extension 26 and is secured by adhesive or an interference fit with the bore, for example. Alternatively the alignment pin 78 can be integral with the cylinder section 46 and/or the collar 48. The alignment pin 78 and the recess 77 can be configured so that when the alignment pin 78 engages the recess 77 (FIG. 4), the bolt interlocking section 56 of the barrel extension 26 is properly aligned within the receiver to receive the forward portion of the bolt head 30 and to interlock with the bolt head 30. The barrel extension 26 could be otherwise configured or omitted without departing from the disclosure. For example, the collar 48, the locking lugs 60 and recesses 62, and/or the alignment pin 78 could be formed with (e.g., integral with) and/or directly attached to the rear end 12*b* of the barrel 12.

As illustrated in FIGS. 2 and 4, the barrel nut 42 can include a body 80 defining an axial bore 82 and a plurality of radial bores 84. The axial bore 82 can provide clearance for the rear end 12*b* and the shoulder 66 of the barrel 12 to pass through and engage the barrel extension 26. Accordingly, the barrel nut 42 can slide over and along the barrel 12 to engage the collar 48 of the barrel extension 26 and the front end 73 of the receiver 14, as shown in FIGS. 1A and 4. In the illustrated embodiment, the barrel nut 42 includes a forward end 86, a rearward end 88, an intermediate annular shoulder 90, and a threaded portion 92 extending from the rearward end 88 to proximate the intermediate annular shoulder 90.

As shown in FIGS. 1A-2, 5A, and 6, the radial bores 84 are disposed between the forward end 86 and the intermediate annular shoulder 90 and generally are spaced substantially equally around a circumference of the body 80 of the barrel nut 42. The number of radial bores 84 can be varied with there being a sufficient number and spacing between the bores to enable engagement thereof from either side and from various angles as needed for disengagement of the barrel nut. The radial bore can be any suitable mating geometry (e.g., various bore shapes, slits, cutouts, protuberances, detents, grooves, etc.) without departing from the disclosure. The threaded portion 92 is configured to provide clearance for the collar 48 and is internally threaded to engage the externally-threaded portion 73*a* of the front end 73 of the receiver 14 (FIGS. 2 and 4). Accordingly, the barrel nut 42 can be tightened onto the front end 73 over the barrel 12 and the barrel extension 26 until the intermediate annular shoulder 90 engages the forward face 70 of the collar 48, thereby securing the barrel 12 and the barrel extension 26 in the front end 73 of the receiver 14. In one embodiment, the barrel nut 42 and the front end 73 can apply a clamp force to the collar 48 between the forward facing surface 75 of the receiver 14 and the intermediate annular shoulder 90 of the barrel nut 42.

Figure 5A:
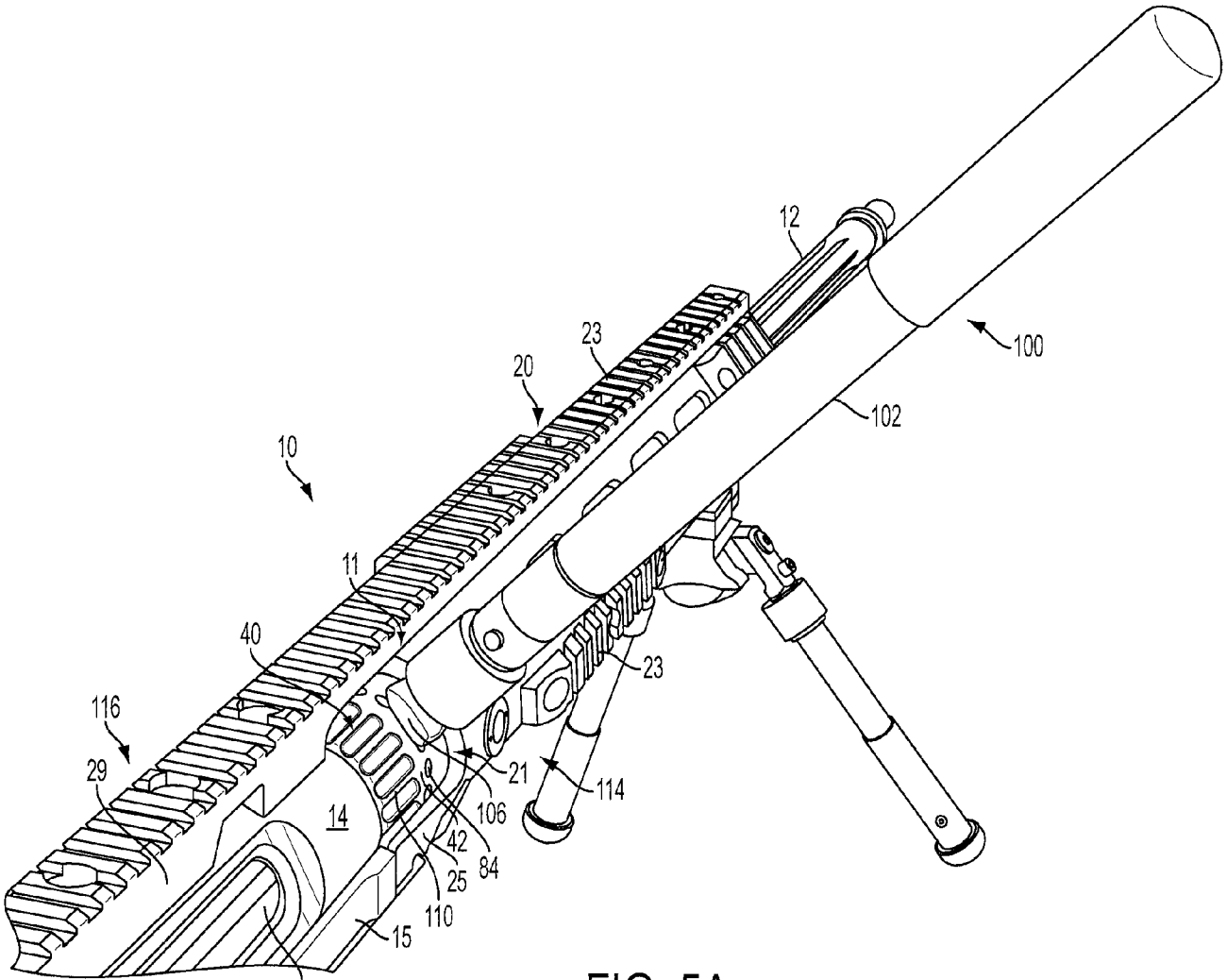
FIGS. 5A-5B are isometric views of the firearm of FIG. 1A illustrating the detachment and barrel removal according to the principles of the present invention.

In the illustrated embodiment, the radial bores 84 of the barrel nut 42 can be configured to receive an end of a tool 100, which can include a variety of wrenches, pry-bars, or other similar tools, including knives and other common tools used by soldiers and hunters in the field that can be used to engage at least one radial bore 84 for tightening and at least initially loosening the barrel nut 42 from its engagement with the front end 73 of the receiver 14. By way of example, as shown in FIG. 5A, the tool 100 can include an elongate handle 102, one or more tool projections 104, and a tool guard 106. The tool projection 104 can be received in any of the radial bores 84 of the barrel nut 42 that is accessible through the cutout 21 in the hand guard 20 (FIGS. 1A-1C). The tool guard 106 can have a curved surface for engaging the curved outer surface of the barrel nut 42. The tool 100 is shown by way of example only. Generally, any suitable tool can be used to interface with the radial bores 84 (or other mating geometries) of the barrel nut 42 to provide a mechanical advantage for tightening and loosening the barrel nut 42 of the front end 73 of the receiver 14. For example, the tool can be a torque wrench, and/or it can include multiple prongs, projections, recesses, etc. for engaging multiple radial bores 84 or other mating geometries. The tool also can be compact for easier carrying and storing, for example, including a shortened or a telescoping and/or folding handle/tool body for compact storage and providing more mechanical advantage in use.

The barrel nut 42 further can include ridges 110 to provide a gripping surface that can be used for tightening and loosening the barrel nut 42 on the front end 73 of the receiver 14. Accordingly, the barrel nut 42 can be initially tightened onto the front end 73 by a user's fingers, which can grip the ridges 110 and rotate the barrel nut 42 in the clockwise direction. The barrel nut 42 can be securely tightened onto the front end 73 by inserting the tool projection 104 into an radial bore 84 at the cutout 21 and pushing or pulling the handle 102 of the tool 100 to rotate the barrel nut 42 in the clockwise direction. Similarly, the barrel nut 42 can be initially loosened by inserting the tool projection 104 into an radial bore 84 at the cutout 21 and pushing or pulling the handle 102 to rotate the barrel nut 42 in the counterclockwise direction. A user then can loosen the barrel nut 42 further by gripping the barrel nut 42 at the ridges 110 and rotating the barrel nut 42 in the counterclockwise direction.

As shown in FIG. 5A, the tool 100 can access the barrel nut 42 through the cutout 21 on the first side 114 of the firearm 10 so that pushing up on the tool 100 rotates the barrel nut 42 in a clockwise motion to tighten the barrel nut 42 onto the front end 73 of the receiver 14. Pulling down on the tool 100 on the first side 114 of the firearm 10 rotates the barrel nut 42 in a counterclockwise motion to loosen the barrel nut 42. Alternatively, the tool 100 can access the barrel nut 42 through the cutout 21 on the opposing second side 116 of the firearm 10 so that pulling down on the tool 100 rotates the barrel nut 42 in a clockwise motion to tighten the barrel nut 42 onto the front end 73 and pushing up on the tool 100 rotates the barrel nut 42 in a counterclockwise motion to loosen the barrel nut 42. In an alternative embodiment, the threaded portion 92 of the barrel nut 42 and the externally-threaded portion 73*a* of the front end 73 could be threaded so that turning the barrel nut 42 in a counterclockwise motion tightens the barrel nut 42 onto the front end 73 and rotating the barrel nut 42 in a clockwise motion loosens the barrel nut 42.

According to one embodiment, the barrel 12 of the firearm 10 can be exchanged with an another barrel 12 without disassembling the hand guard assembly 20 and/or other features of the firearm. For example, the barrel may be replaced by a barrel with a different length and/or that is configured for use with a different caliber of ammunition. The original barrel extension 26 and barrel nut 42 can be used with the alternate barrel, or one or both of the barrel extension 26 and barrel nut 42 can be replaced with the barrel. In the illustrated embodiment, the barrel change-out operation can be initiated by disengaging the bolt assembly 22 from the barrel extension 26 and retracted within the receiver 14. For example, the bolt handle 34 can be manipulated to rotated the bolt assembly 22 and align the lugs 61 of the bolt head 30 with the recesses 62 of the barrel extension 26. The bolt assembly 22 can then be at least partially retracted in the receiver 14 so that the lugs 61 pass through the recesses 62 and the bolt head 30 is removed from the bolt-receiving end 52 of the barrel extension 26. The bolt assembly 22 can be fully removed from the receiver 14 so that the firing pin 24, the bolt head 30, and/or other features of the bolt assembly 22 can be replaced.

As shown in FIG. 5A, the tool projection 104 of the tool 100 can be inserted into one of the radial bores 84 that is accessible through the cutout 21 of the hand guard assembly 21. In FIG. 5A, the tool 100 is inserted through the cutout 21 from the first side 114 of the firearm 10; however, the tool 100 could be inserted through the cutout 21 from the second side 116 of the firearm. With the tool projection 104 inserted into the respective radial bore 84, the tool guard 106 of the tool 100 can contact the outer surface of the barrel nut 42 adjacent the radial bore 84. Pulling downwardly on the handle 102 of the tool 100 can help loosen the barrel nut 42 on the front end 73 of the receiver 14. Friction due to contact between the intermediate annular shoulder 90 of the axial bore 82 of the barrel nut 42 and the forward face 70 of the collar 48 of the barrel extension 26 can resist rotation of the barrel nut 24 relative to the barrel extension 26 and the front end 73. Additionally, residue can build up between the annular should 90 of the barrel nut 42 and the collar 48 of the barrel extension 26 and/or between the threaded portions 73*a*, 92 from the primer and the propellant of the rounds R after several firing operations to form an adhesive bond between the barrel nut 42 and the front end 73. Also, stress from firing operations can further tighten the barrel nut 42 on the front end 73, which can make it more difficult to initiate turning of the barrel nut 42. However, the tool 100 can form a lever to provide a mechanical advantage to overcome the friction and any adhesion between the annular shoulder 90 and the collar 48 and/or the threaded portions 73*a*, 92 and to rotate the barrel nut 42 in a counterclockwise motion.

Figure 5B:
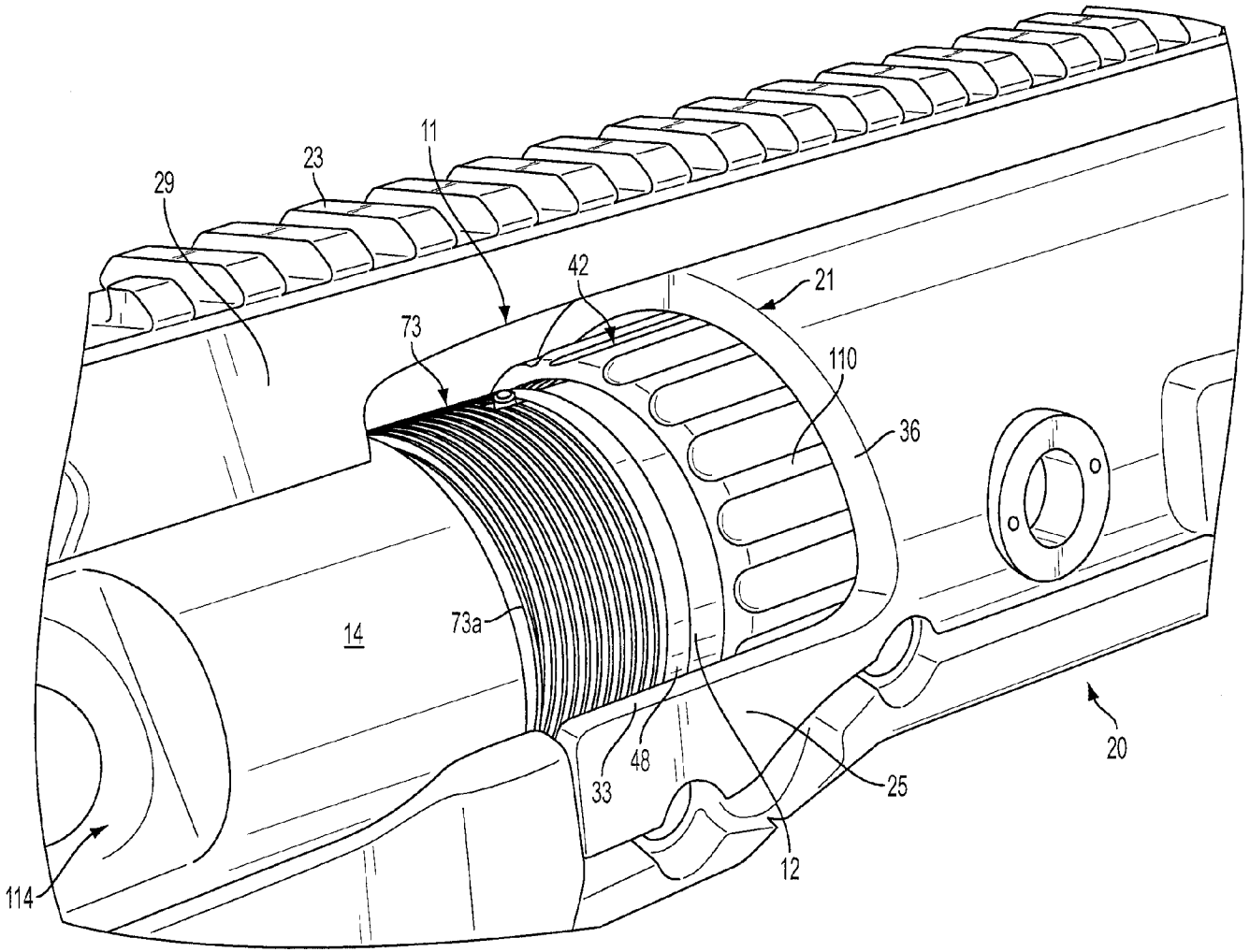

The interfacing of the threaded portion 92 of the barrel nut 42 and the externally-threaded portion 73*a* of the front end 73 moves the barrel nut 42 away from the receiver 14 and the barrel extension 26 along the longitudinal axis L as the barrel nut 42 rotates in the counterclockwise direction. Accordingly, the intermediate annular shoulder 90 of the barrel nut 42 is moved away from the forward face 70 of the collar 48 so that the barrel nut 42 can be more easily rotated in the counterclockwise direction. The tool 100 can be withdrawn from the firearm 10, and the barrel nut 42 can be further rotated in the counterclockwise direction with a user's fingers until the threaded portion 92 of the barrel nut 42 is disengaged from the externally-threaded portion 73*a* of the front end 73 (FIG. 5B).

Figure 6:
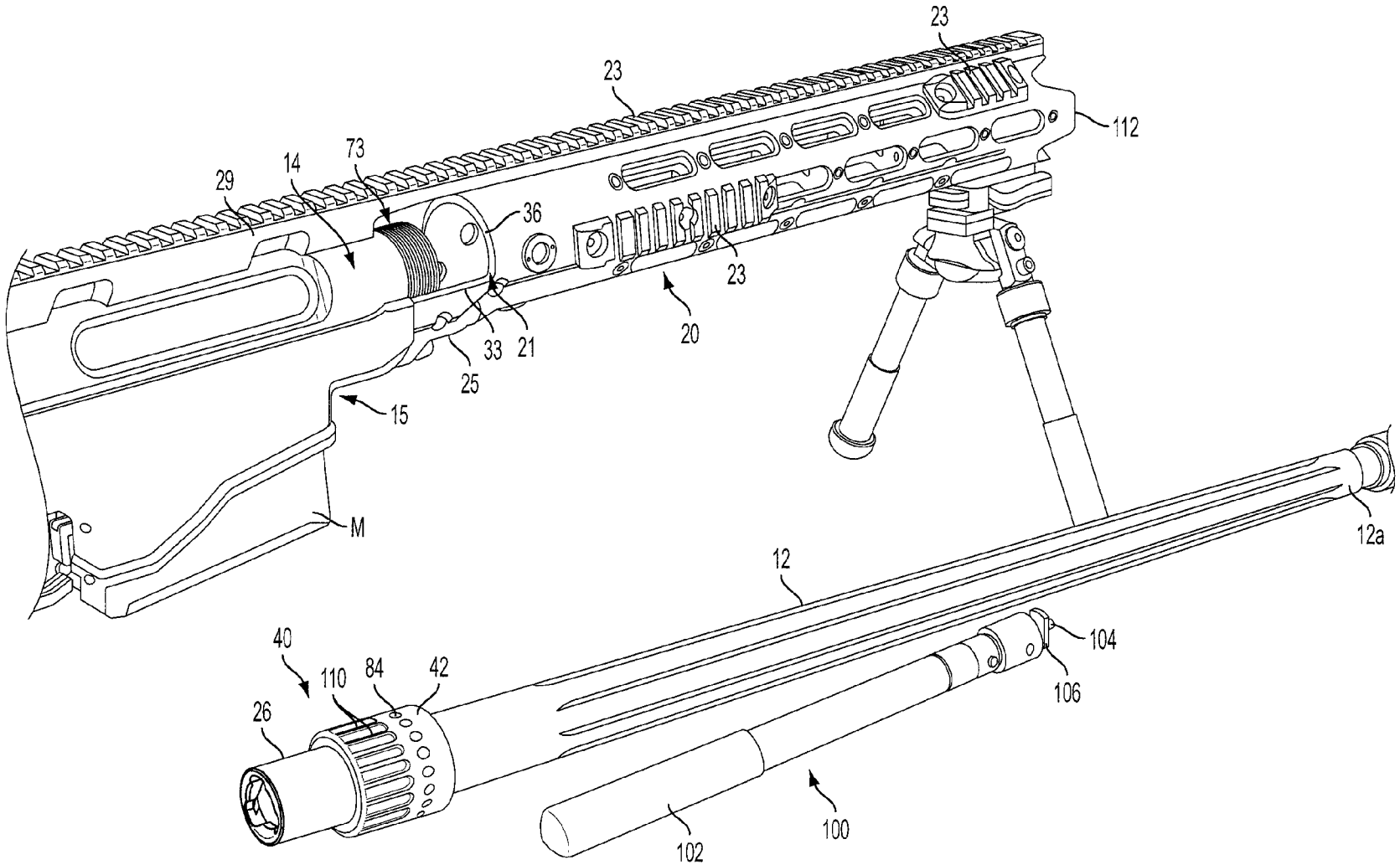
FIG. 6 is an isometric view of the firearm of FIG. 1A with the barrel removed and a tool according to the principles of the present invention.

In the illustrated embodiment, after the bolt head 30 has been disengaged from the bolt-interlocking section 56 of the barrel extension 26 and the barrel nut 42 has been disengaged from the front end 73 of the receiver 14 (FIG. 5B), the barrel 12 can be pulled away from the receiver 14, withdrawing the cylinder section 46 from the axial bore 72 of the receiver 14. As shown in FIG. 6, the barrel 12, the barrel extension 26, and the barrel nut 42 can be pulled through a forward end 112 of the hand guard 20 to be fully removed from the firearm 10 while the hand guard 20 remains mounted on the receiver 14 and/or the chassis 15. The barrel 12, the barrel extension 26, and the barrel nut 42 can be removed from the firearm 10 by other steps and/or features without departing from the disclosure.

In one embodiment, the barrel 12, the barrel extension 26, and the barrel nut 42 can be reassembled to the receiver 14 by generally reversing the removal steps. Particularly, the rear end 12*b* of the barrel 12 can be engaged with the axial bore 50 of the barrel extension 26 by screwing the threaded portion 59 of the rear end 12*b* into the threaded section 58 of the axial bore 50 until the forward face 70 of the barrel extension 26 engages the shoulder 66 of the barrel 12. In a particular embodiment, the rear end 12*b* can be further secured to the barrel extension 42 with adhesives, set screws, other fasteners, or combinations thereof, although such additional attachment devices are not required with the present disclosure. The barrel nut 42 can slide over the barrel 12 from the muzzle end until the axial bore 82 of the barrel nut 42 is proximate the rear end 12*b* of the barrel (FIG. 6). The barrel extension 26, the barrel 12, and the barrel nut 42 can be inserted through the forward end 112 of the hand guard 20 and the cylinder section 46 of the barrel extension 26 can be inserted into the axial bore 72 of the receiver 14. The barrel 12 and the barrel extension 26 can be rotated to align the alignment pin 78 of the barrel extension 26 with the recess 77 of the front end 73 of the receiver 14, and the barrel extension 26 can be further inserted into the axial bore 72 until the alignment pin 78 is received in the recess 77 (FIG. 4) and the rearward face 68 of the collar 48 of the barrel extension 26 engages the forward facing surface 75 of the receiver 14 and/or the rearward face of the bolt-receiving end 52 of the barrel extension 26 engages the stop shoulder 76 of the receiver 14 (FIG. 4).

The barrel nut 42 can be secured onto the front end 73 of the receiver 14 by engaging the threaded portion 90 of the barrel nut 42 with the externally-threaded portion 73*a* of the front end 73 and rotating the barrel nut 42 in the clockwise direction. A user can initially tighten the barrel nut 42 on the front end 73 with fingers by gripping the ridges 110 through the cutout 21 of the hand guard assembly 20 on one or both sides 114, 116 of the firearm 10 and rotating the barrel nut 42 at least until the radial bores 84 are disposed within the cutout 21. With the radial bores 84 accessible through the cutout 21, the tool projection 104 of the tool 100 can be inserted into one of the radial bores 84 (e.g., from the first side 114 of the firearm 10 as shown in FIG. 5A). The handle 102 of the tool 100 can be pushed upwardly in order to tighten barrel nut 42 onto front end 73 until the intermediate annular shoulder 90 of the barrel nut 42 engages forward face 70 of the collar 48 of the barrel extension 26 (FIG. 4). Accordingly, the barrel nut 42 can clamp the collar 48 between the forward facing surface 75 of the receiver 14 and the intermediate annular shoulder 90 of the barrel nut 42 to help secure the barrel 12 and the barrel extension 26 to the receiver 14. The bolt assembly 22 can be pushed forward within the receiver 14 so that the bolt head 30 engages the bolt-interlocking section 56 of the barrel extension 26. Accordingly, the lugs 61 of the bolt head 30 can be aligned with the recesses 62 between the locking lugs 60 of the barrel extension 26, bolt assembly 22 can be pushed forward so that the lugs 61 are generally clear of the locking lugs 60 within the axial bore 50 of the barrel extension 26. The bolt assembly 22 can be rotated by the bolt handle 34 so the lugs 61 are aligned with the locking lugs 60 and the bolt head 30 is locked with the barrel extension 26 (FIG. 4). The barrel 12, the barrel extension 26, and the barrel nut 42 can be secured to the firearm 10 by other steps and/or features without departing from the disclosure.

In one embodiment, the firearm 10 can be prepared for firing by engaging the magazine M with rounds R with the chassis 15, rotating the bolt assembly 22 by the bolt handle 34 to align the lugs 61 with the recesses 62, and pulling the bolt assembly 22 rearwardly in the receiver 14 by the handle 34 so that a round R can enter the receiver 14 ahead of the forward-facing end of the bolt head 30. The bolt assembly 22 can be pushed forwardly in the receiver 14 by the handle 34 to push the round R forwardly toward the chamber 19. The bolt assembly 22 can be locked with the barrel extension 26 as described above, while the bolt head 30 pushes the round R into the chamber 19. The firing operation can be actuated by operating the fire control 16 (e.g., pulling the trigger 17). After the firing operation, the bolt assembly 22 can be withdrawn in the receiver 14 to eject the spent cartridge or shell casing of the round R and to receive a new round R for chambering and preparing for firing.

In operation, the firearm 10 (FIG. 1) is prepared for firing when the bolt assembly 22 loads a round of ammunition R in to the chamber portion 19 of the firearm. The bolt head 30 carries the round R into the axial bore 50 at the bolt-receiving end 52 of the barrel extension 26 and the lugs 61 of the bolt head 30 pass through the recesses 62 between the locking lugs 60 at the bolt-receiving end 52. With the lugs 61 in the interlocking section 56, the round R is fully inserted into the chamber portion 19 of the barrel 12, and the bolt assembly 22 is rotated to align the lugs 61 with the locking lugs 60 at the bolt-receiving end 52 and lock bolt assembly 22 to the barrel extension 42 with the round R in the chamber portion 19. When the fire control 16 is actuated, the firing pin 24 strikes the primer of the round, igniting the propellant. Expanding gases from the ignited propellant build up pressure in the barrel 12, driving the bullet portion of the round through the down bore section 12*a* of the barrel. The bolt assembly 22 then can be rotated to unlock the lugs 61 from the barrel extension 42 and to extract the spent casing of the round R from the chamber 19. The spent casing can be ejected from the firearm 10 and a new round can be loaded into the chamber.

Figure 7:
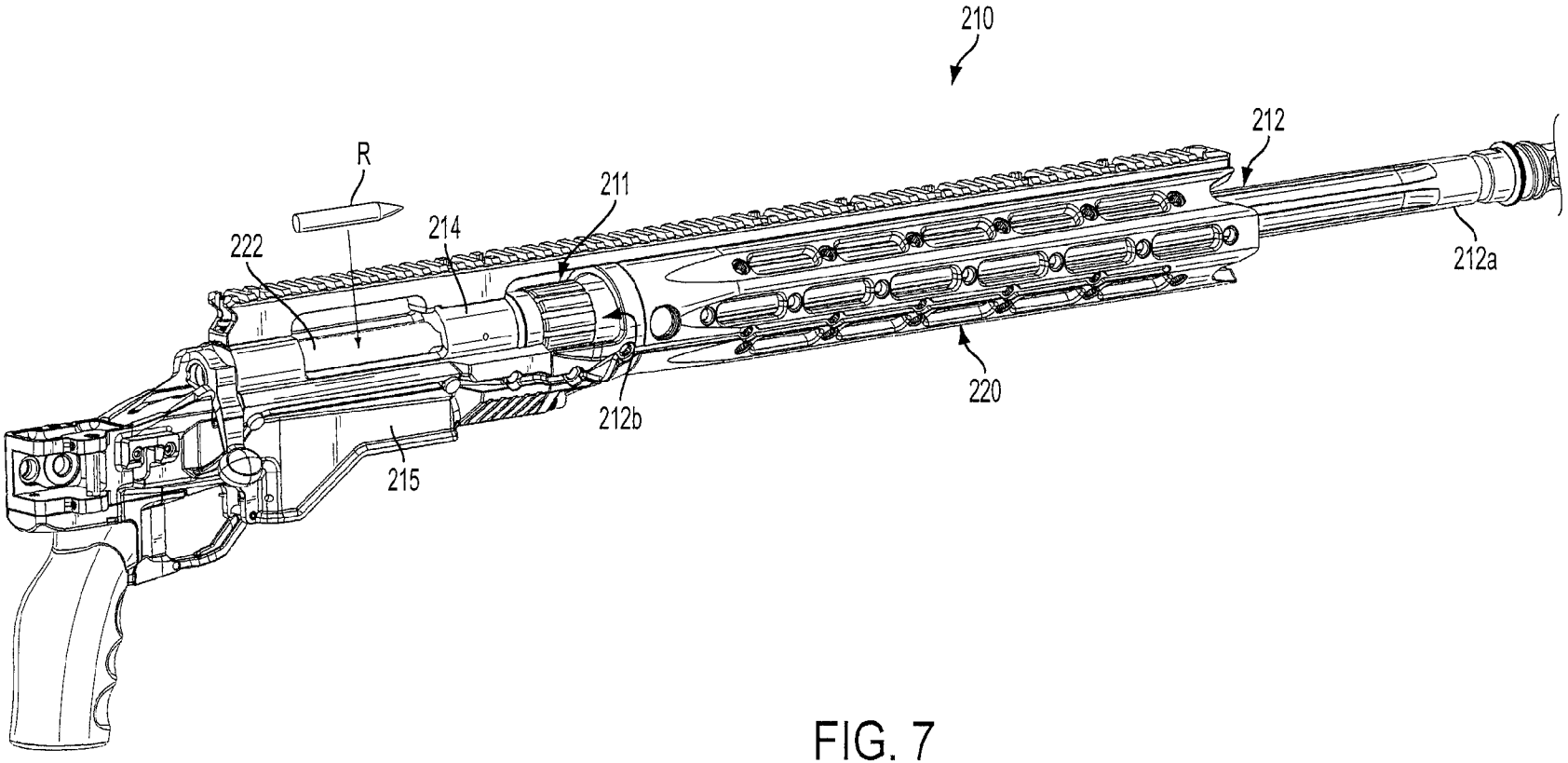
FIG. 7 is an isometric view of a firearm with a quick-detach barrel mounting system according to a second exemplary embodiment of the disclosure.

FIG. 7 is a perspective view of a quick-detach barrel mounting system 211 for a firearm according to a second embodiment of the disclosure. The second embodiment generally is similar to the first embodiment, except for various additional noted features and variations that will be apparent to one of ordinary skill in the art. Accordingly, similar or identical features of the embodiments have been given like or similar reference numbers. As shown in FIG. 7, the quick-detach barrel mounting system 211 is associated with a firearm 210, which can be similar to the firearm 10 of the first embodiment shown in FIG. 1. The firearm 210 can include a barrel 212 mounted to a receiver 214, which is mounted to a chassis 215. The hand guard assembly 220 can be similar or identical to the hand guard assembly 20 of the first embodiment and can include the cutout 21. The hand guard assembly 220 can be mounted to the chassis 215 and the receiver 214 with the barrel 212 extending (e.g., "floating") therein in a similar or identical manner that the hand guard assembly 20 is mounted to the chassis 15 and the receiver 14.

Figure 8:
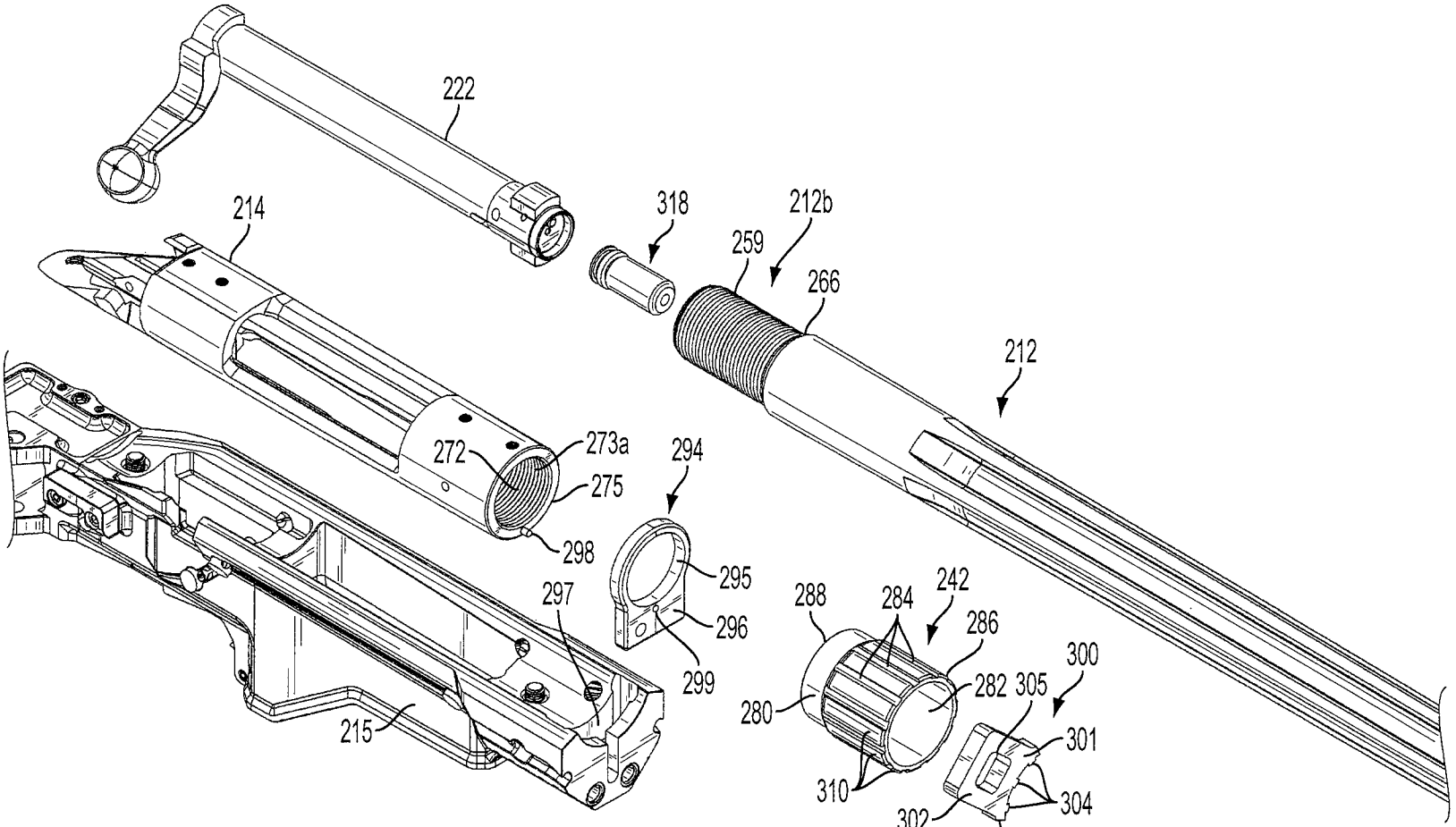
FIG. 8 is an exploded isometric view of features of the firearm of FIG. 7.
Figure 9:
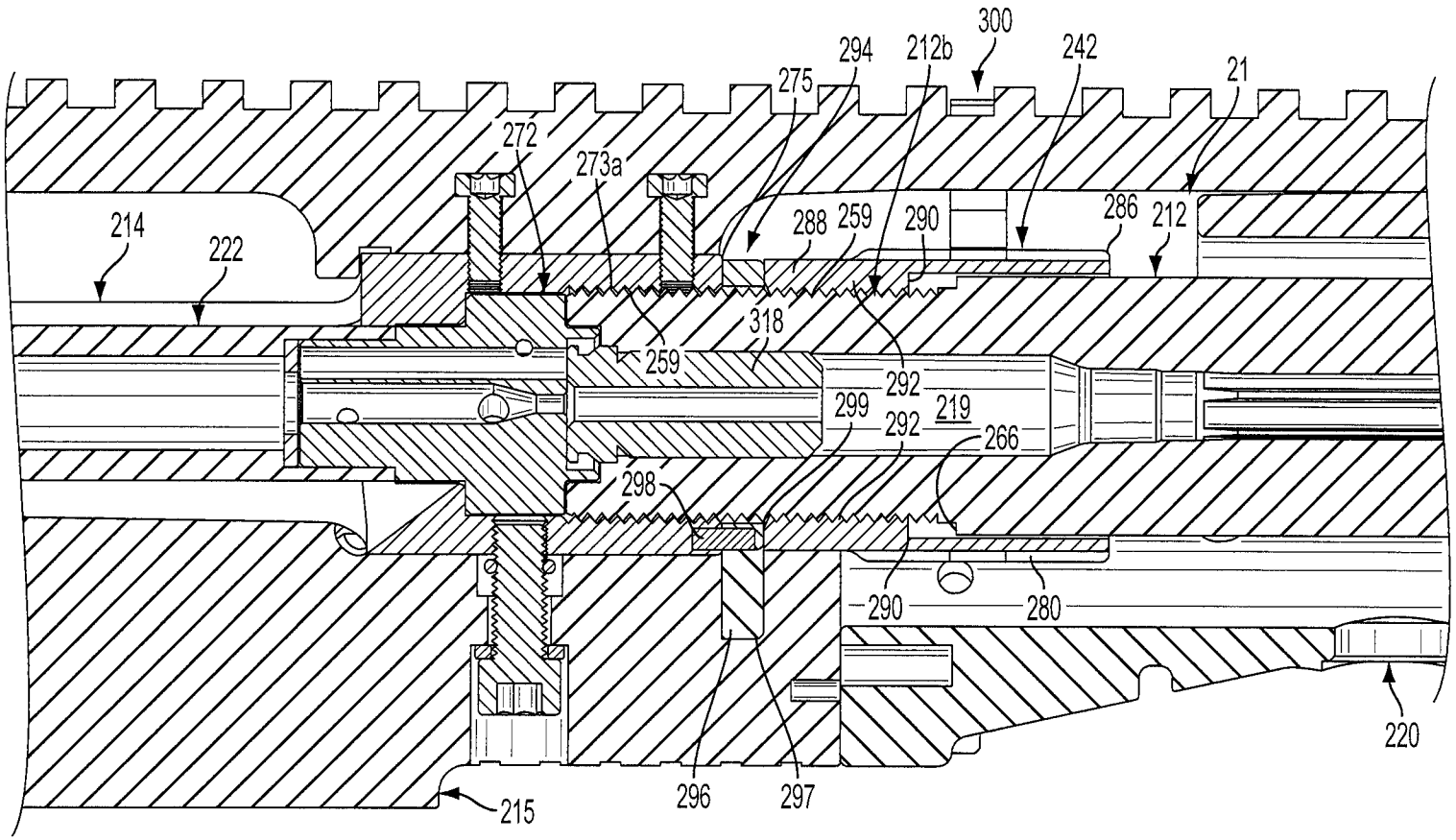
FIG. 9 is a cross-sectional view of the quick-detach barrel mounting system of FIG. 7.

As shown in FIG. 7, the barrel 212 includes a forward or muzzle end 212*a* and a proximal or rear end 212*b*. As shown in FIGS. 8 and 9, the proximal end 212*b* can include external threads 259 for threadably engaging internal threads 273*a* of an axial bore 272 in the receiver 214. In one embodiment, turning the barrel 212 in a clockwise direction (as viewed from the muzzle end 212*a*) can move the barrel rearwardly into the axial bore 272 of the receiver, and turning the barrel in a counterclockwise direction can move the barrel forwardly, out of the receiver 214. A bolt assembly 222 can be at least partially disposed in the receiver 214 and can translate axially along the receiver during the ejection and loading cycle of the firearm. The bolt assembly 222 is located behind and communicates with a chamber portion 219 at the proximal end 212*b* of the barrel 212 in the axial bore 272 of the receiver 214 (FIG. 9). The chamber 219 receives a round of ammunition (FIG. 7), such as a shell or cartridge for firing.

In the illustrated embodiment, a recoil lug or barrel bracket 294 (FIGS. 8 and 9) can be disposed on the proximal end 212*b* of the barrel 212 adjacent the forward facing surface 275 of the receiver 214. The barrel bracket 294 can include a barrel-receiving bore 295 and a flange 296. The proximal end 212*b* of the barrel can extend through the barrel-receiving bore 295, and the flange 296 can be received in a slot 297 in the chassis 215 (FIGS. 8 and 9). An alignment pin 298 can be received in a corresponding alignment bore 299 in the barrel bracket 294 and the forward facing surface 275 of the receiver in order to help align the barrel bracket 294 with the receiver 214. The alignment pin 298 can be secured (e.g., press fit, glued, etc.) within the bore in the barrel bracket 294 or the forward facing surface 275 of the receiver. The barrel bracket 294 can be otherwise configured or omitted without departing from the scope of the disclosure.

Figure 10:
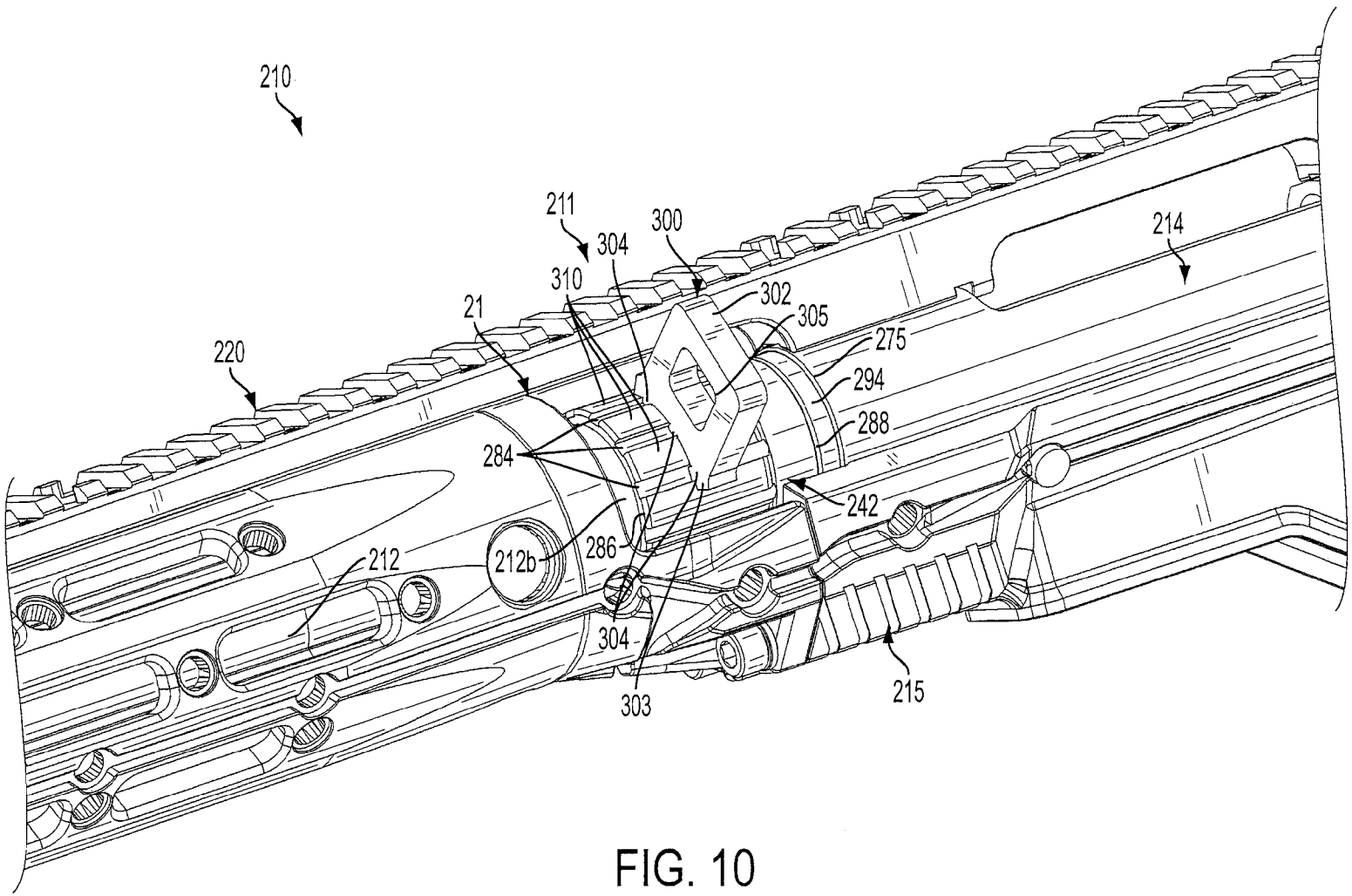
FIG. 10 is an isometric view of the quick-detach barrel mounting system of FIG. 7 with a tool according to the principles of the present invention.

As shown in FIGS. 8-10, the quick-detach barrel mounting system 211 includes a cutout 21 along the hand guard 220 and an barrel nut 242 that can be configured as a jam nut. The barrel nut 242 can include a body 280 defining an axial bore 282. In the illustrated embodiment, the barrel nut 242 includes a forward end 286, a rearward end 288, a forward facing, intermediate annular shoulder 290, and a threaded portion 292 extending from the rearward end 288 to proximate the forward facing shoulder 290. The axial bore 282 can receive the rear end 212*b* of the barrel, and the forward facing shoulder 290 can be configured to engage a shoulder 266 at the forward end of the proximal end 212*b* of the barrel 212 to help prevent the barrel nut 242 from sliding forwardly along the barrel. The threaded portion 292 can engage external threads 259 of the proximal end 212*b* so that, for example, turning the barrel nut 242 in the clockwise direction (as viewed from the muzzle end 212*a*) can move the barrel nut rearwardly along the proximal portion 212*b*, and turning the barrel nut in the counterclockwise direction will move the barrel nut forwardly until the forward facing shoulder 290 engages the shoulder 266 of the barrel 212. The barrel nut 242 can be otherwise configured or omitted without departing from the scope of the disclosure.

As shown in FIG. 8, the barrel nut 242 further can include ridges 310 to provide a gripping surface that can be used for turning the barrel nut 242 on the proximal end 212*b* of the barrel 212. The ridges 310 can define recesses or grooves 284 between adjacent ridges, and the grooves 284 can be configured for mating with a spanner wrench 300 (FIG. 10). The grooves 284 can be any suitable mating geometry (e.g., various bore shapes, slits, cutouts, protuberances, detents, etc.) without departing from the disclosure. Alternatively, the barrel nut 242 can include radial bores 84, cuts or recesses for mating with the tool 100 of the first embodiment.

In the illustrated embodiment, the spanner wrench 300 can include a body 301 with a bracket portion 302 and a semicircular or arc-shaped engaging portion 303. The bracket portion 302 can include an opening 305, which can be configured to receive a torque wrench (not shown) or other tool (e.g., a lever). Alternatively, the bracket portion 302 can be formed as an elongate handle. As shown in FIG. 8, arc-shaped portion 303 includes spaced apart projections 304 that generally can be spaced so as to align with the grooves 284 of the barrel nut 242. The indented portions between the projections 304 also can provide clearance for the ridges 310. The spanner wrench 300 can be otherwise configured or omitted without departing from the scope of the disclosure. In one alternative embodiment, the spanner wrench 300 could be replaced by any suitable tool for engaging one or more grooves 284 and/or ridges 310. In another alternative embodiment, the arc-shaped engaging portion 303 of the spanner wrench can be formed as a closed circle, and can include an elongate, longitudinal rod (not shown). Such a closed circular engaging portion of the spanner wrench can be placed over the muzzle end 212*a* of the barrel 212, and the rod can be used to push the alternative spanner wrench rearwardly along the barrel, and along the interior of the hand guard 220, until the bracket portion 302 is accessible via the cutout 21 of the hand guard.

Accordingly, the barrel nut 242 can be initially tightened against the barrel bracket 294 by a user's fingers, which can grip the ridges 310 and rotate the barrel nut 242 in the clockwise direction. The barrel nut 242 further can be securely tightened against the barrel bracket 294 by sliding the spanner wrench 300 over the barrel nut 242 with the projections 304 sliding along the grooves 284 and then pushing or pulling the spanner wrench 300 to further rotate the barrel nut 242 in the clockwise direction. When the barrel nut 242 is sufficiently tightened on the proximal end 212*b* of the barrel 212, the barrel nut clamps the barrel bracket 294 against the forward facing surface 275 of the receiver 214, and the threaded portion 292 of the barrel nut pulls the external threads 259, and thus the proximal portion 212*b*, forwardly. The pulling of the proximal portion 212*b* is resisted by the interaction of the internal threads 273*a* of the axial bore 272 of the receiver and the external threads 259 of the proximal end. Accordingly, tightening of the barrel nut 242 increases the friction between the external threads 259 of the barrel and the internal threads 273*a* of the receiver, which frictional engagement can help resist turning forces, recoil forces, vibrations, and other forces that can lead to loosening of the proximal end 212*b* in the axial bore 272 of the receiver. To change the barrel, the barrel nut 242 thereafter can be initially loosened by sliding the spanner wrench 300 over the barrel nut to engage the projections 304 with the grooves 284 and then pushing or pulling the spanner wrench to rotate the barrel nut 242 in the counterclockwise direction. A user then can loosen the barrel nut 242 further by removing the spanner wrench 300, gripping the barrel nut 242 at the ridges 310, and rotating the barrel nut 242 in the counterclockwise direction.

In one embodiment, the barrel 212 of the firearm 210 can be exchanged (e.g., for a barrel configured for a different caliber of ammunition, for a barrel with a different length, and/or to replace a worn-out barrel) with the quick-detach barrel mounting system 211. Accordingly, the spanner wrench 300 can be inserted into the cutout 21 of the hand guard 220 on either side of the firearm 210 so that the arc-shaped portion 303 is disposed over the rearward end 288 of the barrel nut 242, to the rear of the ridges 310. Alternatively, the arc-shaped engaging portion 303 could be positioned over the barrel 212 adjacent the forward end 286 of the barrel nut 242. The projections 304 of the spanner wrench 300 are generally aligned with respective grooves 284 of the barrel nut 242, and the spanner wrench is moved along the barrel nut 242 so that the projections 304 slide within the grooves 284.

A tool, such as a torque wrench (e.g., the tool 100 of the first embodiment), a lever, etc., also can be engaged with the opening 305 of the spanner wrench 300, and the tool can be used to push or pull the spanner wrench in the counterclockwise direction (as viewed from the muzzle end 212*a* of the barrel 212). Accordingly, the projections 304 of the spanner wrench will push against the sides of the respective grooves 284 of the barrel nut to urge the barrel nut 242 in the counterclockwise direction to help overcome the forces helping to retain the barrel nut 242 in position (e.g., the friction between the rearward end 288 of the barrel nut and the barrel bracket 294, stresses causing friction between the threaded portion 292 of the barrel nut and the external threads 259 of the proximal end 212*b* of the barrel, residue build-up between the barrel nut and the proximal end of the barrel, etc.). As the barrel nut 242 rotates in the counterclockwise direction, the barrel nut will be moved forward along the proximal end 212*b* of the barrel 212 and away from the receiver 214 and the barrel bracket 294.

After the barrel nut 242 is initially loosened on the proximal end 212*b* of the barrel, the spanner wrench 300 can be removed by sliding the spanner wrench forwardly or rearwardly along the barrel nut until the projections 304 are disengaged from the grooves 284. The spanner wrench then can be removed through the cutout 21, and a user can reach through the cutout 21 and grasp the barrel nut 242 at the ridges 310 to continue turning the barrel nut in the counterclockwise direction so that the barrel nut moves forwardly on the proximal end 212*b*. In one embodiment, the barrel nut 242 can be rotated until the forward facing shoulder 290 of the barrel nut engages the shoulder 266 of the barrel. With the barrel nut 242 moved away from the receiver 214, the tension between the external threads 259 of the proximal end 212*b* of the barrel 212 and the internal threads 273*a* of the axial bore 272 of the receiver 214 will be reduced, and the barrel 212 can be rotated in the counterclockwise direction to unscrew the proximal end 212*b* from the axial bore 272. Accordingly, the barrel 212 can be withdrawn from the rest of the firearm 210 through the barrel-receiving bore 295 of the barrel bracket 294 and the interior of the hand guard 220. The barrel nut 242 further can be rotated in the clockwise direction to unscrew the barrel nut from the proximal end 212*b* of the barrel. The barrel 212 can be removed by other steps and/or features without departing from the present disclosure.

To install the new barrel, the barrel nut 242 can be engaged with the proximal end 212*b* of the new/different barrel 212 by inserting the proximal end into the forward end 286 of the barrel nut and engaging the threaded portion 292 with the external threads 259 of the proximal end of the barrel. The barrel nut 242 then can be screwed onto the proximal end of the barrel until the forward facing shoulder 290 engages the shoulder 266 of the barrel 212. A gauge 318 can be inserted into the chamber 219 of the barrel for helping to position the proximal end 212*b* in the axial bore 272 of the receiver 214 with the proper spacing from the bolt assembly 222 in the locked, ready to fire position for ensuring proper safe case support and rifle function. The gauge 318 can be otherwise configured or omitted without departing from the description.

Thereafter, the proximal end 212*b* of the barrel and the barrel nut 242 can be inserted through the forward end of the hand guard 220, and the proximal end can be inserted through the barrel-receiving bore 295 of the barrel bracket 294 to engage the axial bore 272 of the receiver. The external threads 259 of the proximal end can be engaged with the internal threads 273*a* of the axial bore 272, and the proximal end 212*b* can be screwed into the axial bore 272 by rotating the barrel 212 in the clockwise direction. As shown in FIG. 9, with the bolt assembly 222 in the locked position (e.g., moved forward in the receiver 214 and with the bolt head engaged with the axial bore 272), the gauge 318 will engage the bolt head and prevent further movement of the proximal end 212*b* into the axial bore 272. Accordingly, the installation of a gauge 318 can help to position the barrel in the receiver.

In the illustrated embodiment, a user can reach into the cutout 21 of the hand guard 220, grasp the barrel nut 242 at the ridges 310, and rotate the barrel nut 242 in the clockwise direction to move the barrel nut rearwardly along the external threads 259 of the proximal portion 212*b*. The user can initially tighten the barrel nut 242 against the barrel bracket 294 with fingers, for example. The spanner wrench 300 can be inserted into the cutout 21 so that the arc-shaped portion is forward or rearward of the ridges 310. The projections 304 can be aligned with the grooves 284 and the spanner wrench 300 can slide over the barrel nut 242 with the projections 304 engaged with the grooves 284. A tool (e.g., torque wrench) then can be engaged with the opening 305 of the spanner wrench 300 to tighten the barrel nut 242 on the proximal end 212*b* of the barrel against the receiver 214, clamping the barrel bracket 294 between the rearward end 288 of the barrel nut and the forward facing surface 275 of the receiver and tensioning the external threads 259 of the proximal end 212*b* against the internal threads 273*a* of the axial bore 272.

It therefore can be seen that the construction of the firearm with a barrel mounting and retention device according to the principles of the present disclosure provides a firearm with an apparatus for affixing and retaining the barrel in a locked engagement with the receiver while further providing for substantially quick and easy attachment and removal of the barrel with the receiver without requiring extensive disassembly of the firearm. Thus, the barrel mounting and retention device facilitates a user's easy-attachment and removal/replacement of the barrel to the receiver of a firearm, including firearms with integral or monolithic receivers having hand guards integrally attached or formed therewith. The present barrel mounting and retention system further enables replacement of the barrel without having to remove and/or replace the hand guard or other portions of the firearm. For example, optics (e.g., a day or night scope) attached to the hand guard by a Picatinny rail system would not need to be disassembled when changing the barrel, and may only require adjustment to a predetermined calibration (e.g., the user can have a known calibration for the optics for the particular sighting characteristics of each of the user's different barrels). Accordingly, a user can avoid extensive calibration of optics and/or other accessories requiring additional expertise and time when changing the barrel of a firearm.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the invention. In addition, it is possible to use some of the features of the embodiments described without the corresponding use of the other features. Accordingly, the foregoing description of the exemplary embodiments is provided for the purpose of illustrating the principle of the invention, and not in limitation thereof, since the scope of the invention is defined solely be the appended claims.

What is claimed is:

1. A quick-detach barrel mounting system for removing and attaching a barrel to a receiver of a firearm, the quick-detach barrel mounting system comprising:

a barrel nut having a body defining an axial bore, the axial bore at least partially receiving a proximal end of the barrel therein; and a hand guard extending forwardly from the receiver and along the barrel, the hand guard having a cutout defined proximate to the receiver, wherein the hand guard at least partially encloses at least a portion of the barrel, and the cutout is at least partially aligned with the barrel nut;

wherein at least a portion of the barrel nut is accessible via the cutout of the hand guard for at least partially moving the barrel nut relative to the receiver and the hand guard to enable detachment and mounting of the barrel to the receiver while the hand guard remains in position with respect to the receiver.

2. The quick-detach barrel mounting system of claim 1, further comprising at least one mating geometry formed in a peripheral portion of the body of the barrel nut for receiving at least a portion of a tool, wherein the at least one mating geometry in the barrel nut is accessible to the tool via the cutout of the hand guard.

3. The quick-detach barrel mounting system of claim 2, wherein the at least one mating geometry comprises a plurality of mating geometries spaced around a circumference of the axial bore.

4. The quick-detach barrel mounting system of claim 1, wherein the barrel nut comprises a forward end, a rearward end, an internally threaded portion adjacent the rearward end, and a plurality of ridges formed in an exterior surface of the barrel nut.

5. The quick-detach barrel mounting system of claim 4, wherein the plurality of ridges of the barrel nut defines a plurality of generally longitudinal grooves for at least partially receiving a portion of a tool.

6. The quick-detach barrel mounting system of claim 4, further comprising at least one radial bore formed in a peripheral portion of the body of the barrel nut for receiving at least a portion of a tool, wherein the plurality of ridges of the barrel nut is formed proximate the rearward end of the barrel nut and the at least one radial bore is disposed in a portion of the barrel nut extending between the plurality of ridges and the forward end.

7. The quick-detach barrel mounting system of claim 1, wherein the axial bore of the barrel nut comprises an internally threaded portion that removably engages an externally threaded portion of a front end of the receiver.

8. The quick-detach barrel mounting system of claim 7, wherein the barrel nut comprises an outer circumference and the cutout of the hand guard is configured to extend from a top portion of the barrel nut along at least about a quarter of the outer circumference of the barrel nut on either side of the barrel nut and to extend along and beyond the front end of the receiver for facilitating easy engagement and manipulation of the barrel nut.

9. The quick-detach barrel mounting system of claim 7, further comprising a barrel extension disposed at the proximal end of the barrel, the barrel extension comprising an annular collar and a cylinder section extending between a bolt-receiving end and a barrel-receiving end of the barrel extension, the cylinder section having a threaded section therealong adapted to threadably engage the proximal end of the barrel.

10. The quick-detach barrel mounting system of claim 9, wherein the axial bore of the barrel nut comprises an intermediate annular shoulder, wherein the annular collar of the barrel extension is engaged between the intermediate annular shoulder of the barrel nut and the front end of the receiver as the barrel nut is moved toward the receiver, and the cylinder section of the barrel extension is at least partially received in the front end of the receiver.

11. The quick-detach barrel mounting system of claim 1, wherein the axial bore of the barrel nut comprises an internally threaded portion that removably engages an externally threaded portion of the proximal end of the barrel.

12. The quick-detach barrel mounting system of claim 1, wherein the cutout of the hand guard is at least partially defined by a longitudinal edge of the hand guard, a rearward-facing edge of the hand guard, and a portion of the receiver.

13. The quick-detach barrel mounting system of claim 1, wherein an upper portion of the hand guard adjacent the cutout is spaced apart from barrel nut.

14. A quick-detach barrel mounting system for removing and attaching a barrel to a receiver of a firearm, the quick-detach barrel mounting system comprising:

a barrel nut having a body defining an axial bore at least partially receiving a proximal end of the barrel therein;

wherein the axial bore of the barrel nut comprises an internally threaded portion for engaging an externally threaded portion formed along the proximal end of the barrel for removably attaching the proximal end of the barrel to the receiver; and a hand guard extending forwardly from the receiver and defining a cutout proximate to the receiver, wherein the barrel is received through and extends along the hand guard, and wherein the cutout of the hand guard is at least partially aligned with the barrel nut; and a barrel bracket disposed at the proximal end of the barrel, the barrel bracket comprising a barrel-receiving bore and a flange, the proximal end of the barrel being received in the barrel-receiving bore so that at least a portion of the barrel bracket is disposed between the barrel nut and the receiver, and wherein the flange is at least partially received in a corresponding slot in a chassis of the firearm;

wherein at least a portion of the barrel nut is accessible through the cutout of the hand guard, enabling the barrel nut to be movable relative to the receiver to enable detachment and mounting of the barrel to the receiver while the hand guard remains in position with the barrel extending therethrough.

15. A firearm, comprising:

a receiver comprising a front end, the front end defining a receiver bore;

a barrel defining a chamber at a proximal end thereof, the proximal end of the barrel being at least partially received in the receiver bore;

a hand guard at least partially enclosing at least a portion of the barrel and defining a cutout proximate the receiver, the hand guard being mounted on the receiver; and a barrel nut having a body defining an axial bore, wherein the proximal end of the barrel is received at least partially through the axial bore, and the barrel nut is at least partially aligned with the cutout of the hand guard;

wherein the cutout is configured to facilitate access to at least a portion of the barrel nut through the hand guard for at least partially moving the barrel nut relative to the receiver and the hand guard to enable detachment and mounting of the barrel to the receiver of the firearm without removal of the hand guard from the receiver.

16. The firearm of claim 15, further comprising at least one mating geometry formed in a peripheral portion of the body of the barrel nut for receiving at least a portion of a tool, wherein the at least one mating geometry in the barrel nut is accessible to the tool via the cutout of the hand guard.

17. The firearm of claim 16, wherein the at least one mating geometry comprises a plurality of mating geometries spaced around a circumference of the axial bore.

18. The firearm of claim 15, wherein the barrel nut comprises a forward end, a rearward end, an internally threaded portion adjacent the rearward end, and a plurality of ridges formed in an exterior surface of the barrel nut.

19. The firearm of claim 18, wherein the plurality of ridges defines a plurality of generally longitudinal grooves for at least partially receiving a portion of a tool.

20. The firearm of claim 15, wherein the axial bore of the barrel nut comprises an internally threaded portion that removably engages an externally threaded portion of the front end of the receiver.

21. The firearm of claim 20, further comprising an annular collar extending from the barrel and comprising a first clamp face, wherein the barrel nut comprises an annular shoulder adjacent the axial bore, the front end of the receiver comprises a forward facing surface, and the annular shoulder engages the first clamp face of the annular collar to clamp the annular collar against the forward facing surface of the front end of the receiver.

22. The firearm of claim 21, further comprising a barrel extension disposed at the proximal end of the barrel, the barrel extension comprising the annular collar and a cylinder section extending rearwardly of the annular collar, wherein the barrel extension is at least partially received in the receiver bore of the receiver.

23. The firearm of claim 20, wherein the barrel nut comprises an outer circumference and the cutout of the hand guard is configured to extend from a top portion of the barrel nut along at least approximately a quarter of the outer circumference of the barrel on either side of the firearm and to extend along and beyond the front end of the receiver for facilitating easy engagement and manipulation of the barrel nut.

24. The firearm of claim 15, wherein the cutout of the hand guard is at least partially defined by a longitudinal edge of the hand guard, a rearward-facing edge of the hand guard, and a portion of the receiver.

25. The firearm of claim 24, wherein the hand guard comprises an upper extension that extends over the cutout and the receiver, the upper extension being mounted to the receiver and comprising a monolithic rail.

26. The firearm of claim 15, wherein an upper portion of the hand guard adjacent the cutout is spaced apart from barrel nut.

27. A firearm, comprising:

a receiver comprising a front end, the front end defining a receiver bore;

a barrel defining a chamber at a proximal end thereof, the proximal end of the barrel being at least partially received in the receiver bore;

a hand guard at least partially enclosing at least a portion of the barrel and defining a cutout proximate the receiver, the hand guard being mounted on the receiver;

a barrel nut having a body defining an axial bore, wherein the proximal end of the barrel is received at least partially through the axial bore, and the barrel nut is at least partially aligned with the cutout of the hand guard;

a chassis mounted to the receiver; and a barrel bracket comprising a barrel-receiving bore and a flange, the proximal end of the barrel being received in the barrel-receiving bore so that at least a portion of the barrel bracket is disposed between the barrel nut and the front end of the receiver, wherein the flange is at least partially received in a slot in the chassis;

wherein the cutout of the barrel nut is configured to facilitate access to at least a portion of the barrel nut through the hand guard for at least partially moving the barrel nut relative to the receiver to enable detachment and mounting of the barrel to the receiver of the firearm without removal of the hand guard from the receiver; and wherein the barrel nut further comprises a plurality of mating geometries formed in a peripheral portion of the body of the barrel nut for receiving at least a portion of a tool, the plurality of mating geometries being spaced around a circumference of the axial bore, wherein at least one mating geometry of the plurality of mating geometries in the barrel nut is accessible to the tool via the cutout of the hand guard.

* * * * *